US011855335B2

(12) United States Patent
Hou

(10) Patent No.: US 11,855,335 B2
(45) Date of Patent: Dec. 26, 2023

(54) INTEGRATED ACTIVE ANTENNAS SUITABLE FOR MASSIVE MIMO OPERATION

(71) Applicant: CommScope Technologies LLC, Hickory, NC (US)

(72) Inventor: XiaoHua Hou, Richardson, TX (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 341 days.

(21) Appl. No.: 17/077,388

(22) Filed: Oct. 22, 2020

(65) Prior Publication Data

US 2021/0126351 A1 Apr. 29, 2021

Related U.S. Application Data

(60) Provisional application No. 62/925,088, filed on Oct. 23, 2019.

(51) Int. Cl.

| | |
|---|---|
| ***H01Q 1/24*** | (2006.01) |
| ***H01Q 3/32*** | (2006.01) |
| ***H01Q 3/36*** | (2006.01) |
| ***H01Q 21/08*** | (2006.01) |

(52) U.S. Cl.

CPC ..... *H01Q 1/246* (2013.01); *H01Q 3/32* (2013.01); *H01Q 3/36* (2013.01); *H01Q 21/08* (2013.01)

(58) Field of Classification Search

CPC ..... H01Q 1/246

See application file for complete search history.

(56) References Cited

U.S. PATENT DOCUMENTS

| | | | | |
|---|---|---|---|---|
| 2002/0128007 | A1 | 9/2002 | Miyatani | |
| 2011/0188205 | A1* | 8/2011 | MacManus | H05K 7/20 361/703 |
| 2012/0087284 | A1 | 4/2012 | Linehan et al. | |
| 2016/0028455 | A1 | 1/2016 | Ma et al. | |
| 2017/0170549 | A1 | 6/2017 | Buondelmonte | |
| 2018/0069629 | A1 | 3/2018 | Turgeon et al. | |
| 2018/0316086 | A1 | 11/2018 | Lehman et al. | |
| 2019/0268046 | A1* | 8/2019 | Kim | H01Q 21/29 |

FOREIGN PATENT DOCUMENTS

| | | | | |
|---|---|---|---|---|
| CN | 106099394 | A | 11/2016 | |
| EP | 2744051 | A1 * | 6/2014 | H01Q 1/246 |
| WO | 2017218396 | A1 | 12/2017 | |
| WO | WO-2017218396 | A1 * | 12/2017 | H01P 1/18 |

OTHER PUBLICATIONS

International Search Report and Written Opinion corresponding to PCT/US2020/056404; dated Feb. 9, 2021 (7 pages).

EPC Communication under Rule 164 corresponding to EP 20878558.4; dated Oct. 16, 2023, (13 pages).

* cited by examiner

*Primary Examiner* — Seokjin Kim

(74) *Attorney, Agent, or Firm* — Myers Bigel, P.A.

(57) ABSTRACT

An integrated base station antenna includes a feed board having a plurality of columns of radiating elements mounted thereon and a plurality of phase shifters coupled to the plurality of columns of radiating elements mounted on a same side of the feed board as the plurality of columns of radiating elements.

20 Claims, 38 Drawing Sheets

INTEGRATED ACTIVE ANTENNAS SUITABLE FOR MASSIVE MIMO OPERATION

CROSS-REFERENCE TO RELATED APPLICATION

The present application claims priority to U.S. Provisional Patent Application Ser. No. 62/925,088, filed Oct. 23, 2019, the entire content of which is incorporated by reference herein as if set forth in its entirety.

BACKGROUND

The present invention generally relates to radio communications and, more particularly, to base station antennas for cellular communications systems.

Cellular communications systems are well known in the art. In a cellular communications system, a geographic area is divided into a series of regions that are referred to as "cells," which are served by respective base stations. The base station may include one or more antennas that are configured to provide two-way radio frequency ("RF") communications with mobile subscribers that are within the cell served by the base station. Typically, the base station antennas are mounted on a tower, with the radiation patterns (also referred to herein as "antenna beams") that are generated by the base station antennas directed outwardly. Base station antennas are often implemented as linear or planar phased arrays of radiating elements.

As cellular operators upgrade their networks to support fifth generation ("5G") service, the base station antennas that are being deployed are becoming increasingly complex. For example, due to space constraints and/or allowable antenna counts on antenna towers of existing base stations, it may not be possible to simply add new antennas to support 5G service. Accordingly, cellular operators are opting to deploy antennas that support multiple generations of cellular service by including linear arrays of radiating elements that operate in a variety of different frequency bands in a single antenna. Thus, for example, it is common now for cellular operators to request a single base station antenna that supports service in three, four or even five or more different frequency bands. Moreover, in to support 5G service, cellular operators are also deploying antennas that have multi-column arrays of radiating elements that support multi-input-multi-output ("MIMO") operation and/or active beamforming. For example, antennas having arrays that include four, eight, sixteen or even more columns of radiating elements are now being deployed. Cellular operators are seeking to support all of these services in base station antennas that are comparable in size to conventional base station antennas that supported far fewer frequency bands. This raises a number of challenges.

Additionally, to enhance performance, radios for the above-described beamforming antennas may be integrated into the antenna. This may reduce insertion losses, simplify installation, and eliminate the leasing costs associated with mounting remote radio heads by the base station antennas at the top of an antenna tower. However, integrating the radios into the antennas results in its own set of challenges.

DETAILED DESCRIPTION

Figure 1C:
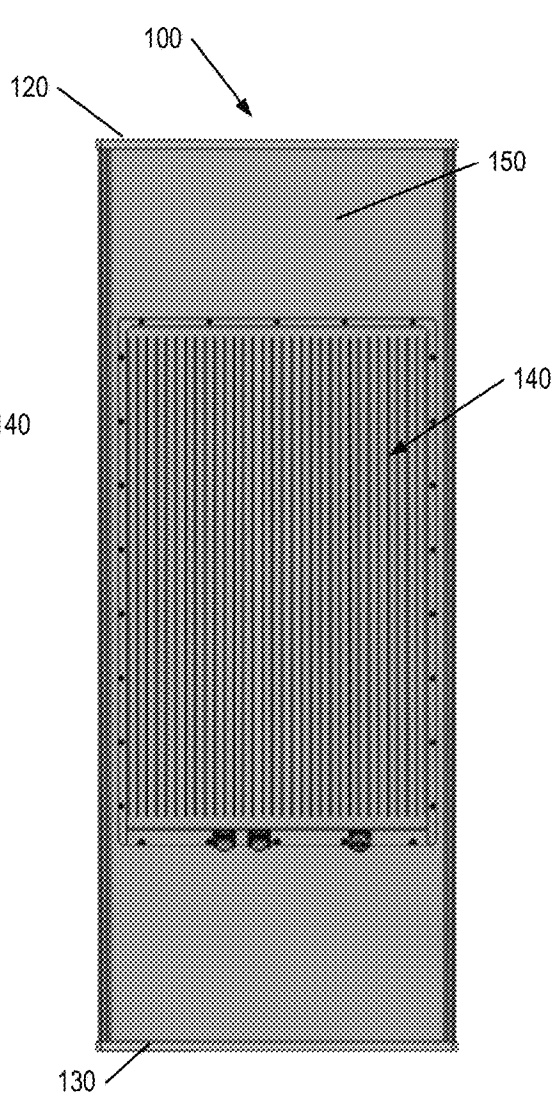
FIGS. 1A, 1B, and 1C are front, side, and back elevation views, respectively, of an integrated base station antenna according to some embodiments of the inventive concept.

In the following detailed description, numerous specific details are set forth to provide a thorough understanding of embodiments of the present invention. However, it will be understood by those skilled in the art that embodiments of the present invention may be practiced without these specific details. In some instances, well-known methods, procedures, components, and circuits have not been described in detail so as not to obscure the disclosure of embodiments of the present invention. Aspects described with respect to one embodiment may be incorporated in different embodiments although not specifically described relative thereto. That is, all embodiments and/or features of any embodiments can be combined in any way and/or combination.

Some embodiments of the inventive concept stem from a realization that a frequency division duplex ("FDD") massive-MIMO antenna may be difficult to implement for various reasons including, but not limited to the following: (1) duplexers, which may be included in the radio circuitry and components, are typically large and may need to support a sharp roll-off outside of the passband; (2) the number of electromechanical phase shifters and associated actuators and mechanical linkages that are used to apply electronic downtilt to the antenna beam may be large; and (3) radio circuitry and components may operate at generally low efficiency, e.g., around 10%, which may result in significant amount of power being converted into heat. Some embodiments of the inventive concept may provide antenna assemblies in which various components of the antenna assembly may be configured to mate directly without the need to couple these components using cables. With fewer cables, the antenna assembly may be smaller, lighter and less susceptible to passive inter-modulation (PIM) interference, and may provide improved accuracy for some functionality, such as calibration of radio signals to ensure that radio frequency ("RF") signals that are provided to different columns of radiating elements are properly calibrated in terms of amplitude and phase alignment.

In some embodiments of the inventive concept, some or all of the electromechanical phase shifters may be integrated into the radiating element feed boards instead of being implemented separately and attached to the feed boards using cables. By implementing the electromechanical phase shifters on the feed boards, they may be located in front of the reflector of the antenna, i.e., on the same side of the reflector as the radiating elements, with the feed boards being coupled to the duplexers by way of the calibration board directly through board-to-board connections, e.g., using board-to-board connectors or pins, without the use of cabling. The mechanical linkages that connect the electromechanical phase shifters to their associated actuators may also be at least partially implemented on the front side of the reflector, providing additional room behind the reflector for radio circuitry and other components. Additionally, in some embodiments, some of the duplexer filtering functionality may be implemented on the calibration board to reduce the size of the duplexers. For example, a low pass filter of each duplexer may be implemented on the calibration board, which may allow the size of each duplexer to be reduced.

A heat sink may be placed behind the radio circuitry and power amplifier circuitry, i.e., on the opposite side of the duplexers, calibration board, and radiating element feed board, to dissipate heat. In some embodiments of the inventive concept, the radio circuitry and power amplifier circuitry may be mounted on a plurality of separate support surfaces instead of being placed on a single monolithic support surface. Separate heat sinks may be used for each of the plurality of support surfaces, which may improve the ability to isolate thermal hot spots due to the division of the radio circuitry and power amplifier circuitry.

Although some embodiments of the inventive concept are described herein in the context of a massive MIMO antenna having beamforming capabilities, it will be understood that other types of antennas may also be provided in accordance with other embodiments of the inventive concept.

Figure 1B:
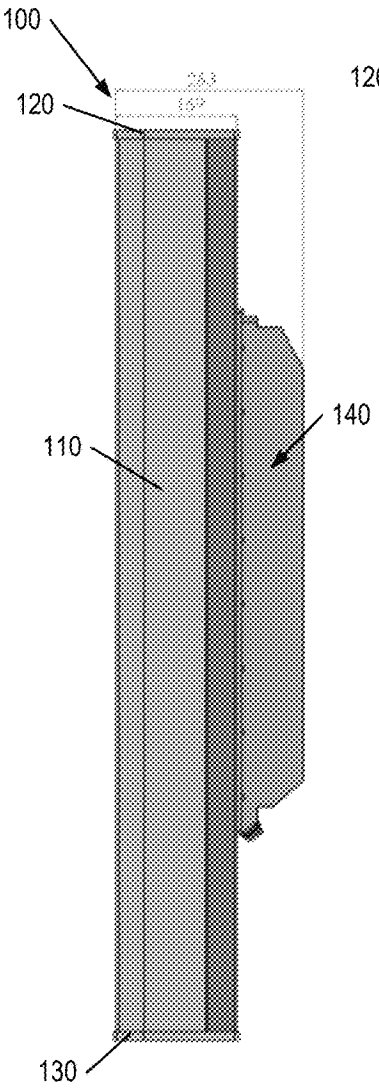
Figure 1A:
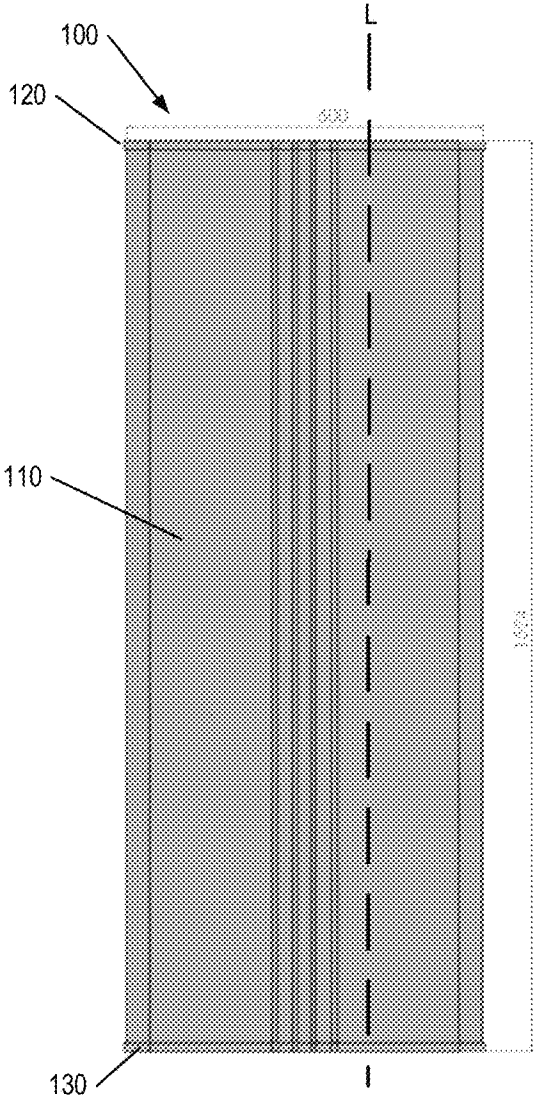
Figure 2A:
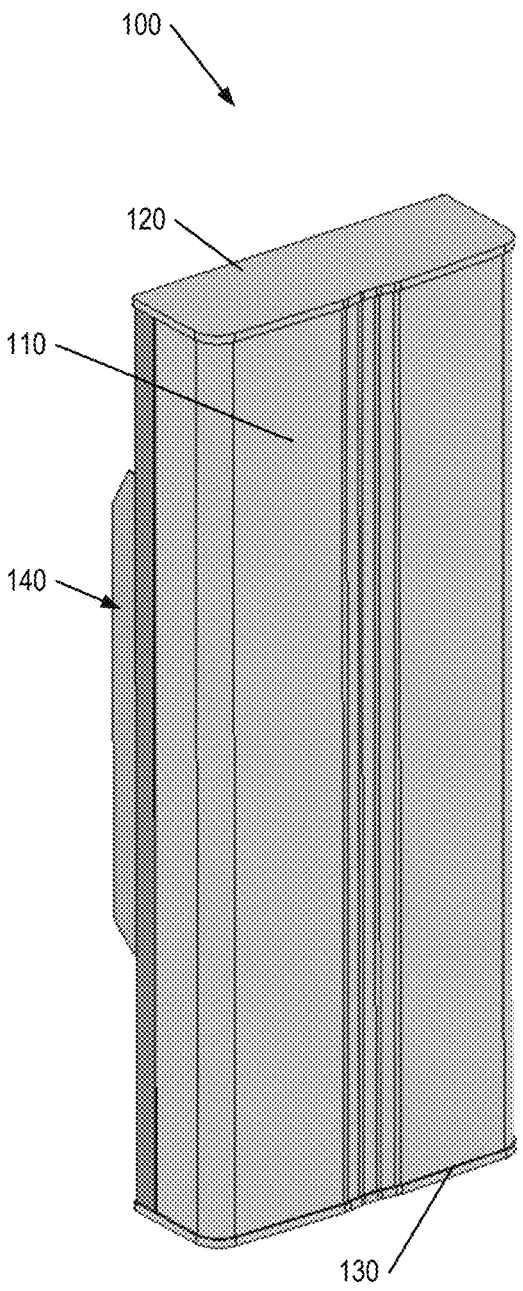
FIGS. 2A and 2B are perspective views of the integrated base station antenna of FIGS. 1A, 1B, and 1C.
Figure 2B:
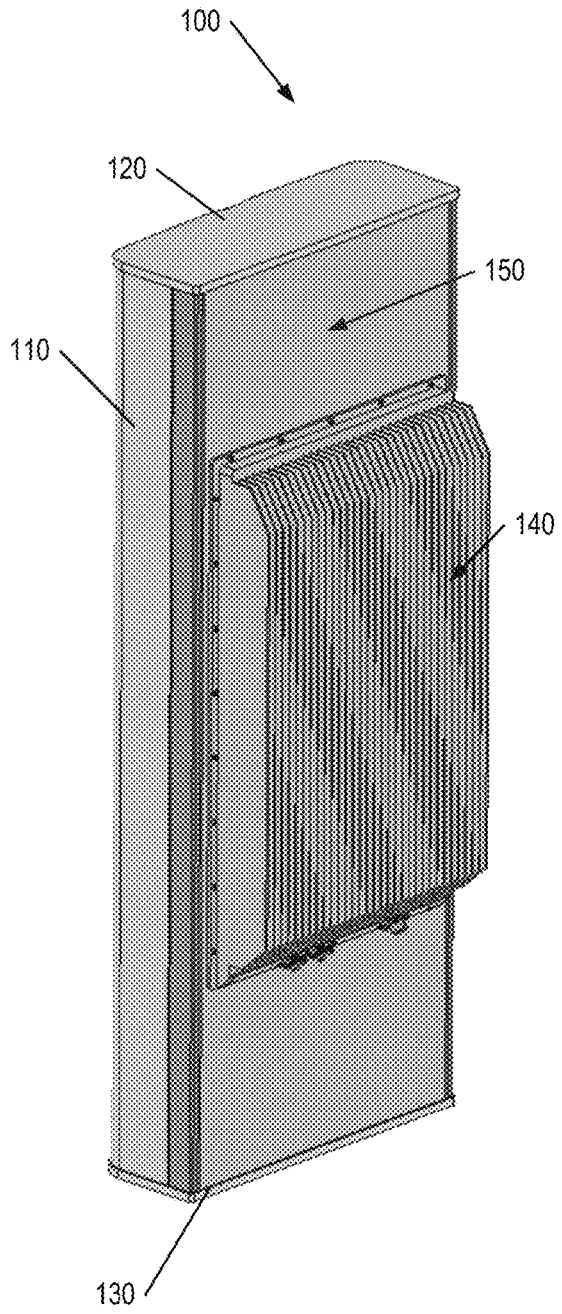

Embodiments of the present inventive concept will now be described in further detail with reference to the attached figures. FIGS. 1A, 1B, and 1C are front, side, and back elevation views, respectively, of an integrated base station antenna 100, i.e., a base station antenna including integrated radio circuitry and power amplifier circuitry according to some embodiments of the inventive concept. FIGS. 2A and 2B are perspective views of the integrated base station antenna 100. In the description that follows, the antenna 100 will be described using terms that assume that the antenna 100 is mounted for use on a tower with the longitudinal axis L of the antenna 100 extending along a generally vertical axis and the front surface of the antenna 100 mounted opposite the tower pointing toward the coverage area for the antenna 100.

Referring to FIGS. 1A, 1B, 1C, 2A, and 2B, the integrated base station antenna 100 is an elongated structure that extends along a longitudinal axis L. The integrated base station antenna 100 may have an elongated box shape with generally rectangular cross-section. The antenna 100 includes a radome 110 and a top end cap 120. The radome 110 and the top end cap 120 may, in some embodiments, comprise a single monolithic unit, which may be helpful for waterproofing the antenna 100. In other embodiments, the top end cap 120 may part of a framework for supporting other elements of the integrated base station antenna 100. One or more mounting brackets (not shown) may be provided on the rear side of the integrated base station antenna 100, which may be used to mount the antenna 100 onto an antenna mount (not shown) that is provided, for example, an antenna tower. The integrated base station antenna 100 also includes a bottom end cap 130, which may be, for example, part of a framework for supporting other elements of the integrated base station antenna 100. The integrated base station antenna 100 is typically mounted in a vertical configuration (i.e., the longitudinal axis L may be generally perpendicular to a plane defined by the horizon) when the integrated base station antenna 100 is mounted for normal operation. The radome 110, top cap 120 and bottom cap 130 may form an external housing for the integrated base station antenna 100. The integrated base station antenna 100 may further include a radio unit module 140 that is coupled to the back of the integrated base station antenna 100, which may include the radio circuitry and power amplifier circuitry therein. The sides and back of the integrated base station antenna 100 may comprise a support framework 150 that may provide structural support for various antenna assembly components, such as the duplexers and an antenna sub-assembly that includes the feed boards on which the columns of radiating elements are mounted.

Figure 3:
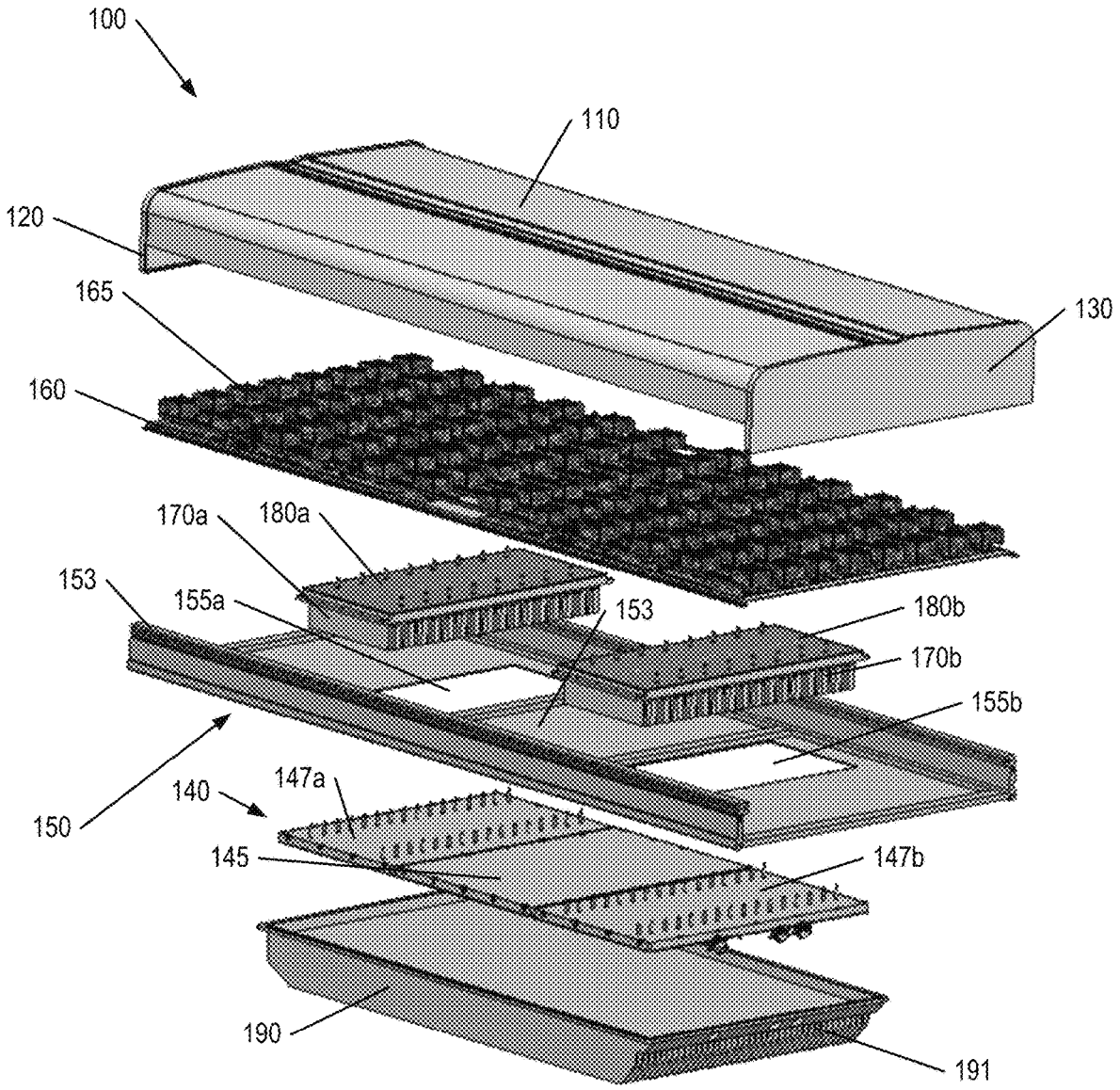
FIG. 3 is an exploded perspective view of the integrated base station antenna of FIGS. 1A, 1B, and 1C.

FIG. 3 is an exploded perspective view of the integrated base station antenna 100. Referring to FIG. 3, the integrated base station antenna 100 comprises the radome 110 and a support framework 150 that includes the top end cap 120 and the bottom end cap 130. An antenna sub-assembly that includes a reflector 160 that has a plurality of feed boards 162 mounted thereon is mounted between the support framework 150 and the radome 110. Each feed board 162 has a plurality of radiating elements 165 mounted thereon. The radiating elements 165 are arranged in columns.

The radiating elements may 165 comprise dual-polarized radiating elements. In the depicted embodiment, each radiating element 165 includes a first dipole radiator that is configured to transmit and receive RF signals at a slant −45° polarization and a second dipole radiator that is configured to transmit and receive RF signals at a slant+45° polarization. The radiating elements 165 may be configured to operate in various frequency bands. According to some embodiments of the inventive concept, the radiating elements 165 may be configured to operate in the 1.7 GHz to 2.2 GHz frequency band. In some embodiments, the radiating elements 165, in conjunction with the radio circuitry in the radio in the radio unit module 140 and the dual-band duplexers 170, may operate in two frequency bands in the 1.7-2.2 GHz frequency range. In the example shown, the antenna includes two, vertically stacked antenna arrays, with each antenna array including eight columns of radiating elements 165, with each column including six dual-polarized radiating elements. With sixteen columns total and each radiating element being dual-polarized, the integrated base station antenna 100 may form a total of thirty-two antenna beams to provide thirty-two transmit paths and thirty-two receive paths. Thus, the antenna 100 may be referred to as a 32T/32R antenna. It will be understood that more or fewer columns of radiating elements 165 may be used in other embodiments of the inventive concept.

Each column radiating elements 165 may be used to form a pair of antenna beams, namely an antenna beam for each of the two polarizations at which the dual-polarized radiating elements are designed to transmit and receive RF signals. Each column of radiating elements 165 may be configured to provide service to a sector of a base station. For example, each column of radiating elements may be configured to provide coverage to approximately 120° in the azimuth plane so that the integrated base station antenna 100 may act as a sector antenna for a three sector base station. It will be appreciated that the columns of radiating elements may be configured to provide coverage over different azimuth beamwidths in other embodiments. While all of the radiating elements 165 are dual-polarized radiating elements in the embodiments described herein, it will be appreciated that in other embodiments some or all of the dual-polarized radiating elements may be replaced with single-polarized radiating elements. It will also be appreciated that while the radiating elements are illustrated as dipole radiating elements, other types of radiating elements such as, for example, patch radiating elements may be used in other embodiments.

As shown in FIG. 3, the support framework 150 may include openings 155 therein which allow the power amplifier circuitry, which is contained in a housing 142 of the radio unit module 140, to connect to the duplexers 170. As will be described hereinafter, the duplexers 170*a,b* may be received in the support framework 150 via the guard rails 152 and may couple to the power amplifier circuitry in the radio unit module 140 through the openings 155*a,b*. The radio unit module 140 may include optical-to-electrical and transceiver circuitry 145, i.e., radio circuitry, along with power amplifier circuitry 147*a,b*. In some embodiments, the power amplifier circuitry 147*a,b* may be divided into two power amplifier circuitry modules 147*a* and 147*b* with the optical-to-electrical and transceiver circuitry 145 therebetween. A heatsink 190 may be coupled to the radio unit module 140. The heatsink 190 may include a plurality of fins 191. The heatsink 190 may be attached to the frame via, for example, bolts or other fasteners.

Figure 4:
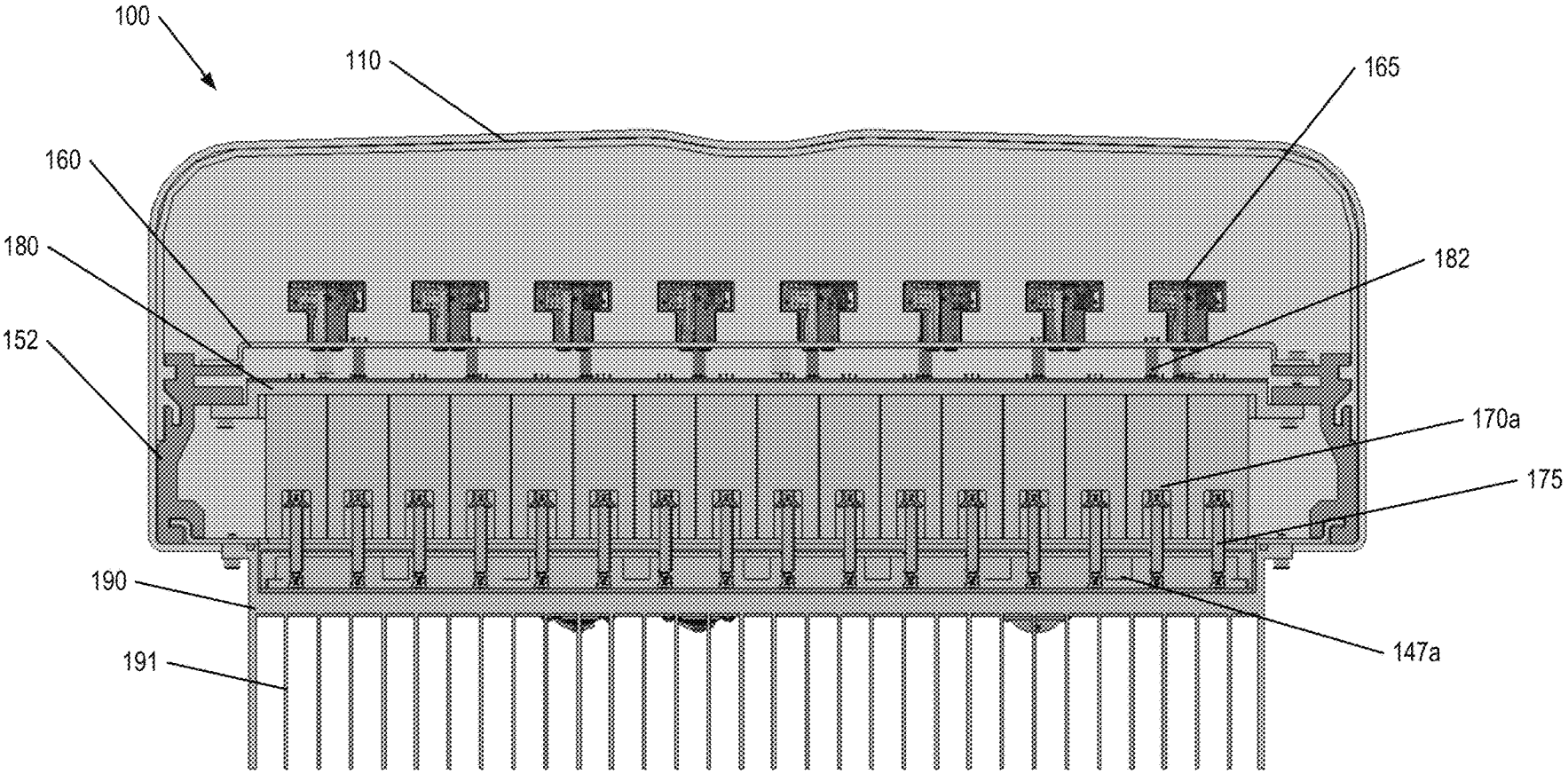
FIG. 4 is a cross-sectional view of the integrated base station antenna of FIGS. 1A, 1B, 1C, 2A, and 2B.

FIG. 4 is a cross-sectional view of the integrated base station antenna 100 of FIGS. 1A, 1B, 1C, 2A, and 2B. As shown in FIGS. 3 and 4, the duplexers 170*a* are mounted between the guard rails 152 of the support framework 150 and are connected to the power amplifier circuitry 147*a* through pins 175, which may be sub-miniature push on (SMP) pins. The radio unit module 140 may be mounted directly on the heatsink 190. The heatsink 190 includes a plurality of external fins extending therefrom that facilitate the dissipation of heat from the power amplifier circuitry 147*a,b* and the optical-to-electrical and transceiver circuitry 145 of the radio module 140. In some embodiments, the heatsink 190 may be configured to dissipate the heat generated by circuitry that uses 1300 watts of power at 5-10% efficiency. The duplexers 170*a* are coupled to a calibration board 180, which in turn is coupled to a plurality of feed boards 162. A plurality of radiating elements 165 are mounted on each feed board 162. The feed boards 162 may be mounted on a front surface of a reflector 160, which may be a generally flat metallic surface, and may serve as a ground plane for the radiating elements 165 that are mounted thereon. The feed boards 162 may be coupled to the calibration board 180*a* via a board-to-board connection using connection points 182. The calibration board 180 may be used to measure amplitude and phase differences between the RF signals that pass to each column of radiating elements 165 so that differences in the amplitude and phase that result from variations in the RF paths may be accounted for by the optical-to-electrical and transceiver circuitry 145, which may, for example, digitally compensate for differences in amplitude or phase in RF signals associated with different columns of the radiating elements 165 and/or physical path adjustments.

As shown in FIG. 3 and the cross-sectional view of FIG. 4, the electrical connections between the feed boards 162 and the calibration boards 180*a,b* may be made via board-to-board connection using connection points 182 on each of the calibration boards 180*a,b*. The connections between the calibration boards 180*a,b* and the duplexers 170*a,b* may each be SMP pin connections, and the connections between the duplexers 170*a,b* and the power amplifier circuitry 147*a,b* may also be SMP pin 175 connections. These board-to-board connections and SMP pin connections may replace cables, which can improve electrical performance by eliminating solder joints that are potential sources of PIM interference, and may also reduce the size and weight of the antenna assembly. Moreover, the elimination of cables along the RF paths after the calibration boards 180*a,b* (i.e., between the calibration boards 180 and the radiating elements 165) may improve the accuracy in evaluating signal phase as cabled connections tend to be more likely than board-to-board connections to introduce phase errors.

In some embodiments, electromechanical phase shifters along with their associated mechanical linkages may be formed on the feed boards 162, and hence may be mounted on the front side of the reflector 160 (i.e., on the same side of the reflector 160 as the radiating elements 165). Implementing the phase shifters on the feed boards 162 as opposed to as separate structures eliminates the need for cabling connections between separate phase shifter structures and the feed boards 162. The elimination of these "phase cables" may further reduce the size and weight of the antenna assembly 100, simplifies the manufacturing process, and also removes numerous solder joints that are potential sources of PIM interference. Each phase shifter may have an input that receives an RF signal and a plurality of outputs that are coupled to sub-arrays of radiating elements 165, with each sub-array including one or more radiating elements 165. The phase shifters may be implemented, for example, as wiper arc phase shifters, such as the phase shifters disclosed in U.S. Pat. No. 7,907,096 to Timofeev, the disclosure of which is hereby incorporated herein in its entirety. Each phase shifter may be coupled to a mechanical linkage that is used to mechanically adjust the setting of the phase shifter in order to apply a desired amount of electronic downtilt to the antenna beam formed by the column of radiating elements 165 that is coupled to the phase shifter. The mechanical linkage may be coupled to a RET actuator such as a direct current motor assembly (not shown). The RET actuator may apply a force to the mechanical linkage, which in turn adjusts a moveable element on the phase shifter in order to adjust the downtilt angle for one or more of the columns of radiating elements 165.

Figure 5A:
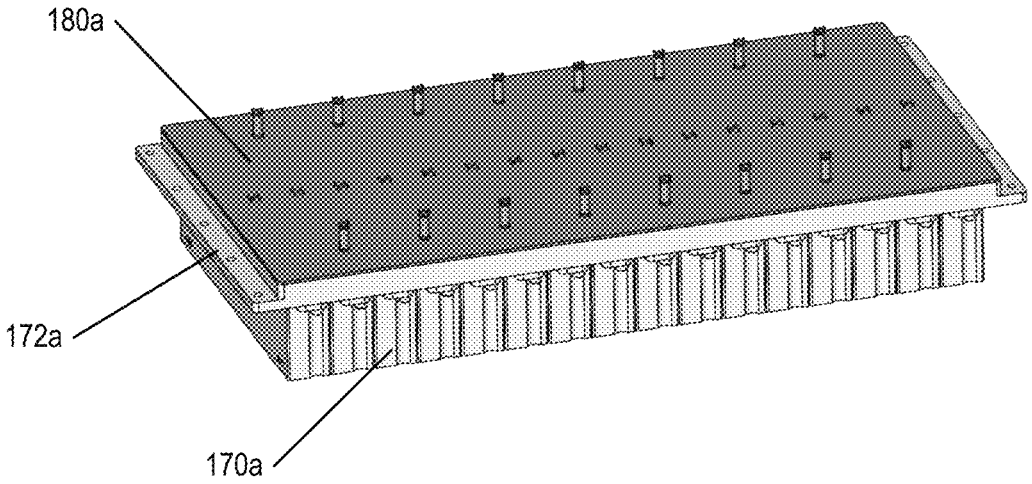
FIGS. 5A and 5B are perspective views of a sub-assembly of FIGS. 3 and 4 that includes a calibration board and a plurality of duplexers according to some embodiments of the inventive concept.
Figure 5B:
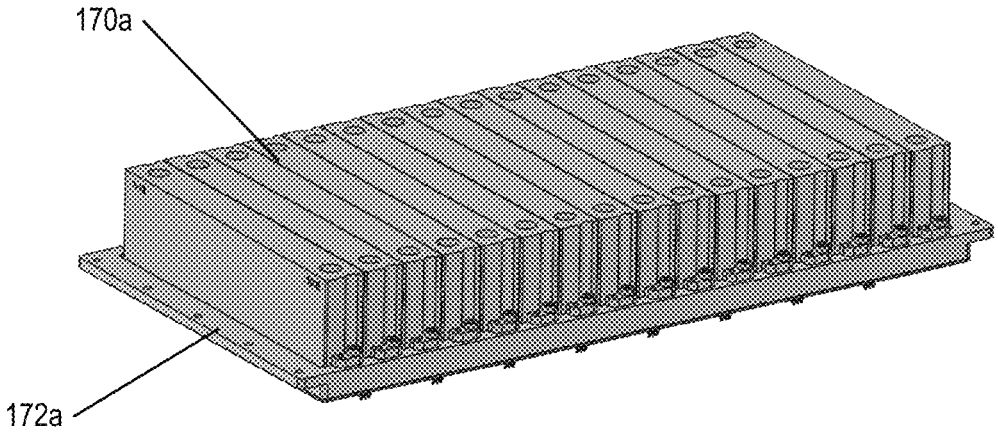
Figure 6A:
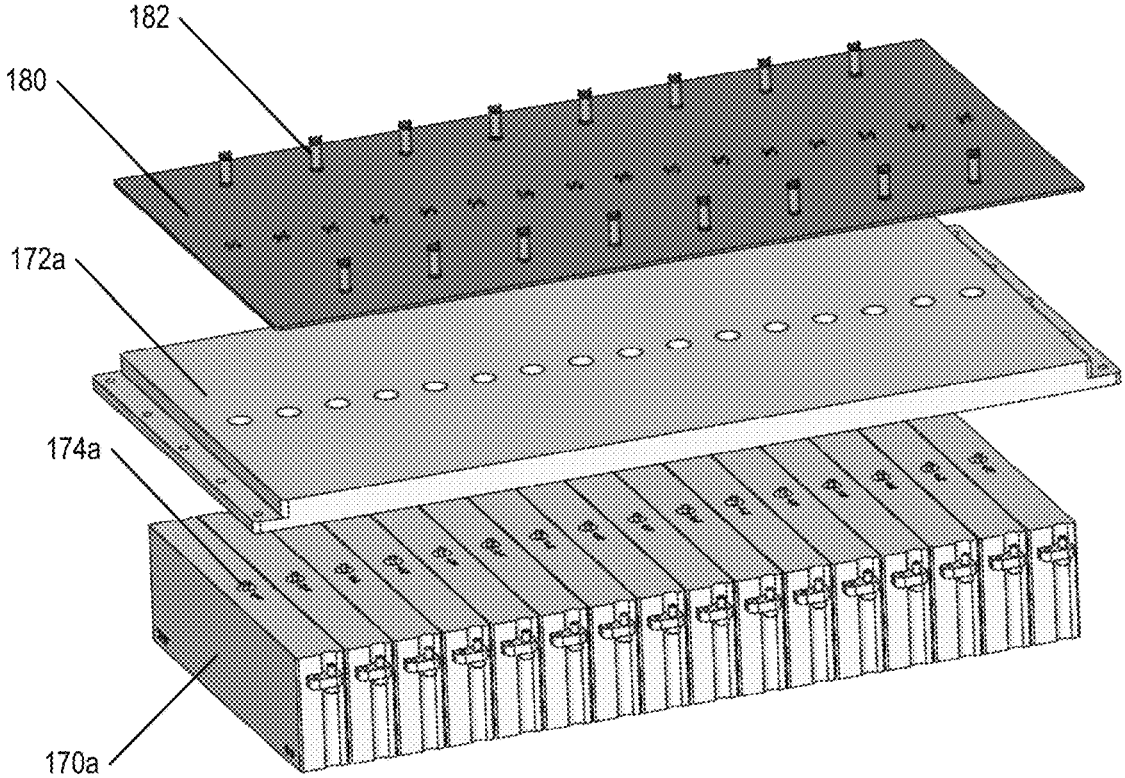
FIGS. 6A and 6B are exploded perspective views of the calibration board/duplexer sub-assembly of FIGS. 3 and 4.
Figure 6B:
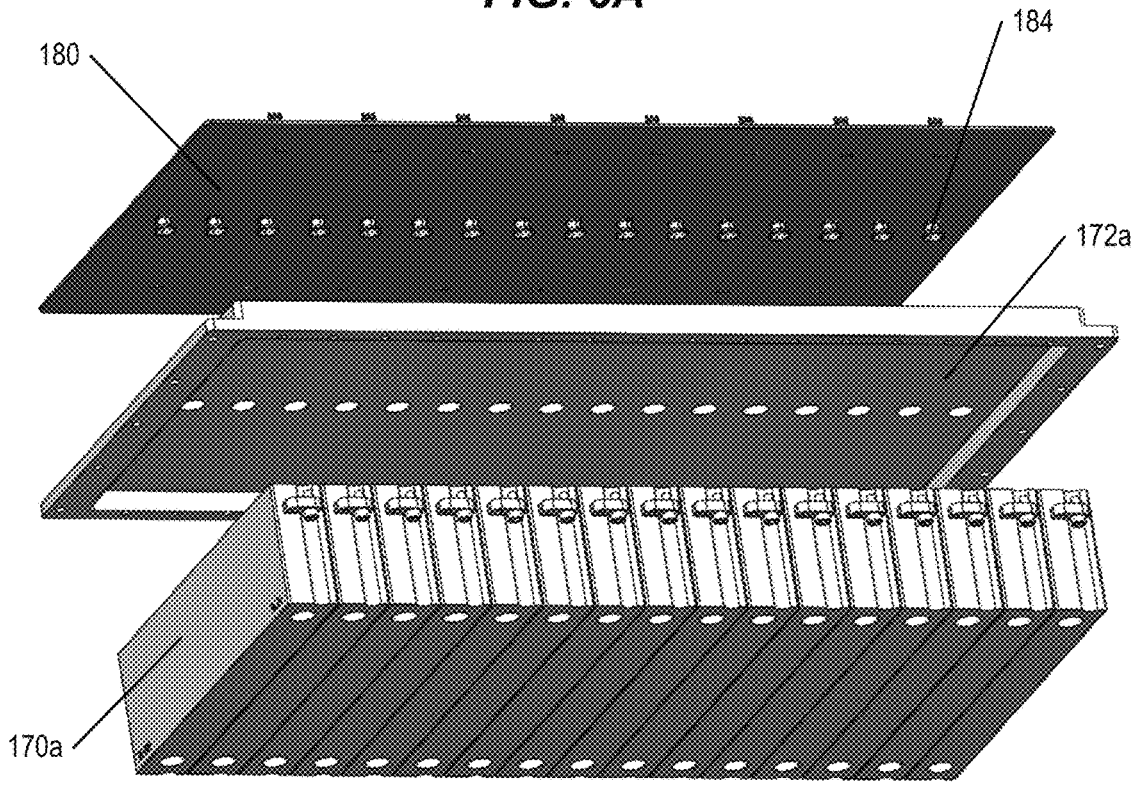

FIGS. 5A and 5B are perspective views of a calibration board/duplexer sub-assembly that includes the calibration board 180 and the duplexers 170*a*. As shown in FIGS. 5A and 5B, the calibration board 180*a* is coupled to the duplexers 170*a* via a base plate 172*a*. FIGS. 6A and 6B are exploded perspective views of the calibration board/duplexer sub-assembly. As shown in FIGS. 6A and 6B, the calibration board 180 includes board-to-board connection points 182 for connecting to the feed boards 162 and male SMP pin connectors 184 for connecting to female SMP connectors 174*a* on the duplexers 170*a*. In some embodiments, some of the filtering functionality of each duplexer 170*a* may be implemented on the calibration board 180. For example, the duplexing operation may require a low pass filter. In some embodiments, this low pass filter for each duplexer may be implemented on the calibration board 180, which may allow the size of each duplexer 170*a* to be reduced. Additional or different filters of each duplexer may be implemented on the calibration board 180 in other embodiments.

Figure 7A:
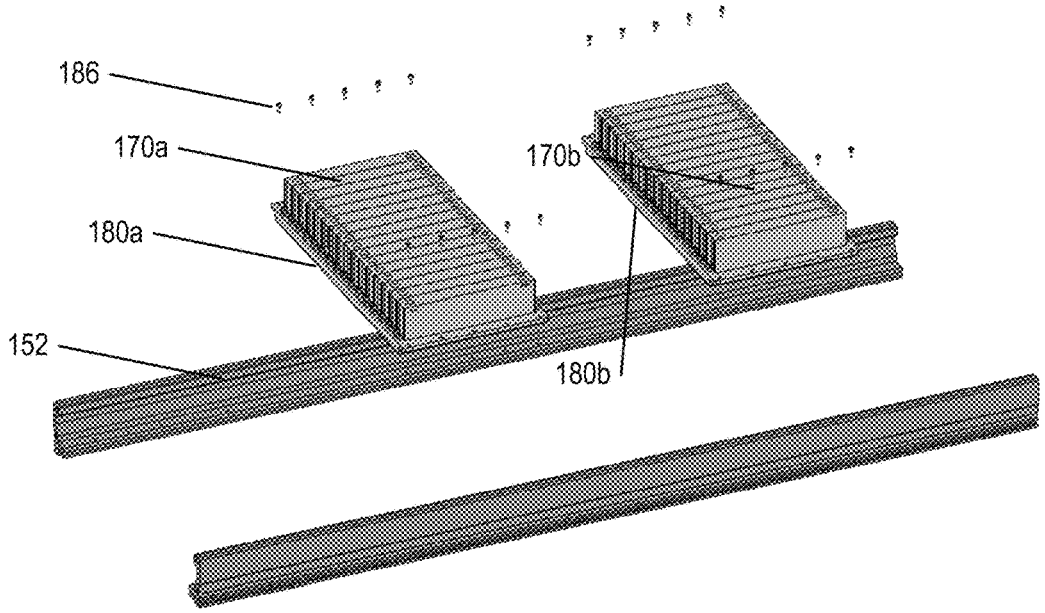
FIG. 7A is an exploded perspective view.
Figure 7B:
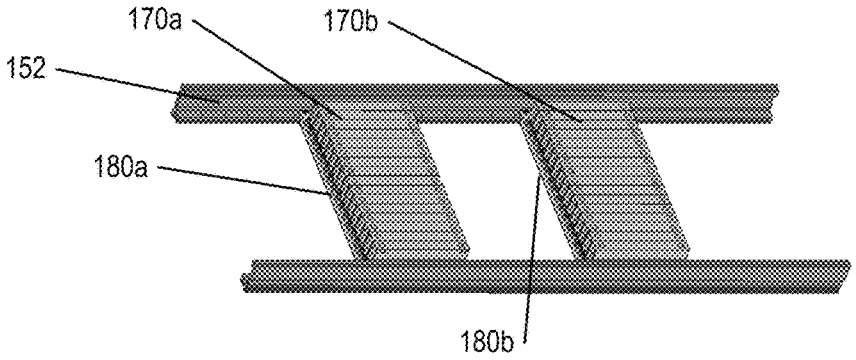
FIGS. 7B and 7C are perspective views, of the calibration board/duplexer sub-assembly of FIGS. 3 and 4 mounted on the guard rails of the support framework shown in FIGS. 3 and 4.
Figure 7C:
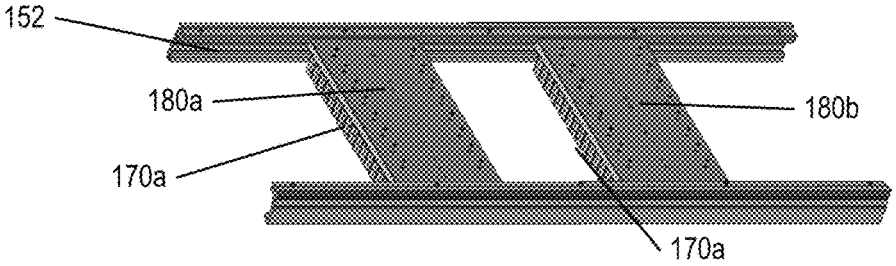

FIG. 7A is an exploded perspective view, and FIGS. 7B and 7C are perspective views, of the calibration board/duplexer sub-assembly of FIGS. 5A-5B and 6A-6B mounted on the guard rails 152 of the support framework 150. As shown in FIGS. 7A-7C, the base plates 172*a,b* of the calibration boards 180*a,b* may be used to attach the calibration board/duplexer sub-assembly to the guard rails 152 using screws 186 or another suitable attachment mechanism.

Figure 8A:
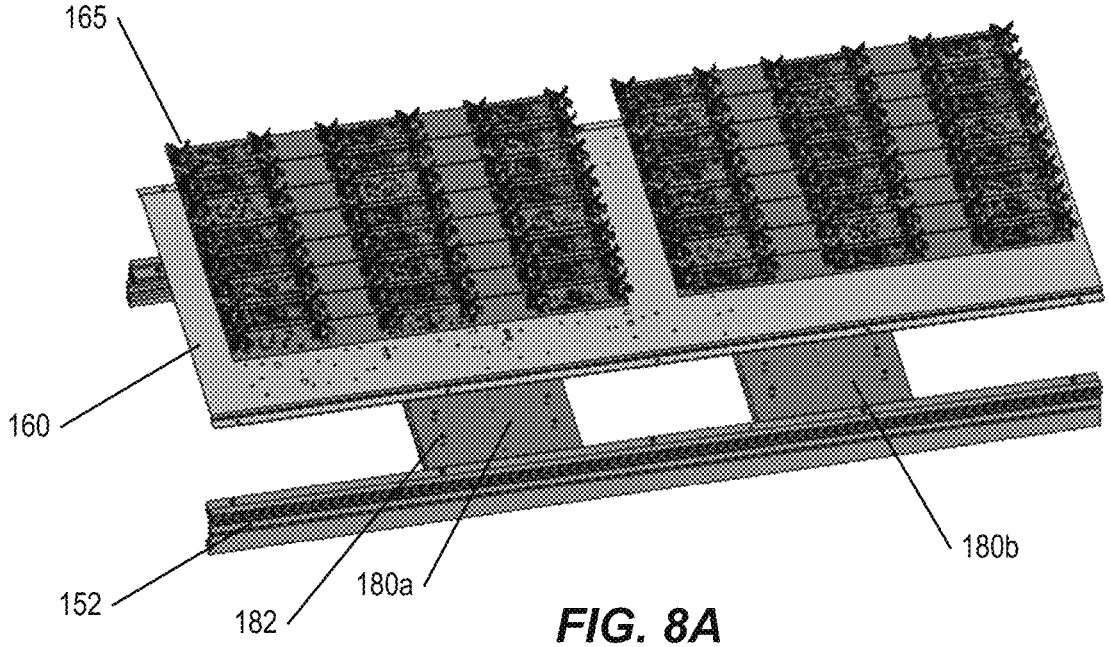
FIG. 8A is an exploded perspective view.
Figure 8B:
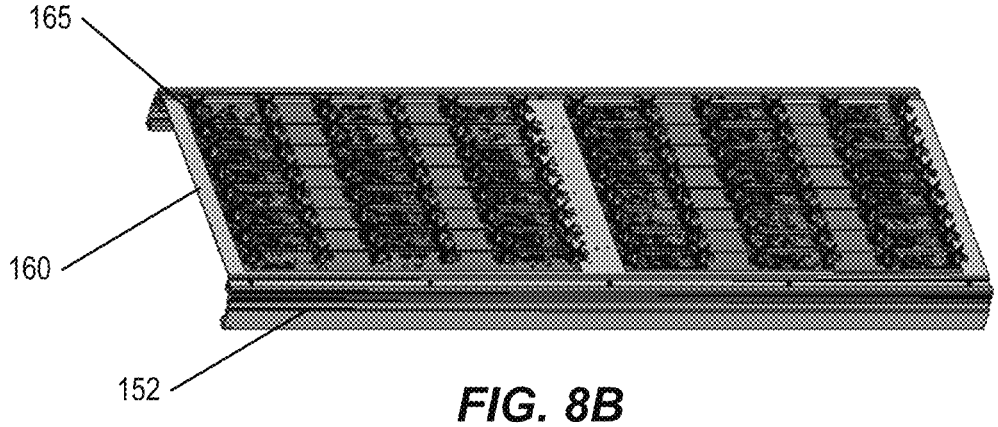
FIGS. 8B and 8C are perspective views, of the antenna and calibration board/duplexer sub-assemblies of FIGS. 3 and 4.
Figure 8C:
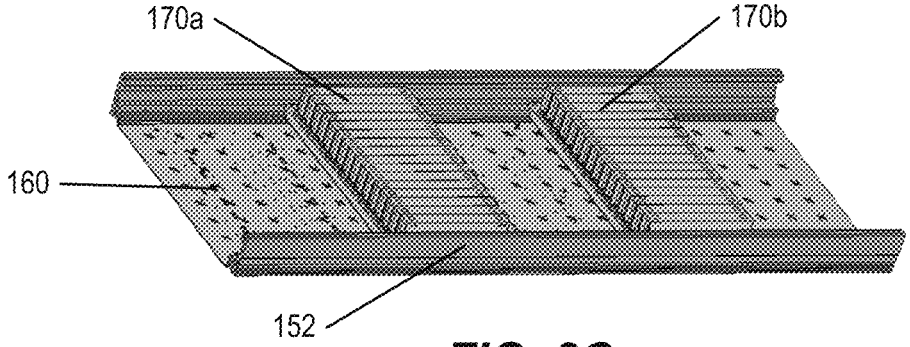

FIG. 8A is an exploded perspective view, and FIGS. 8B and 8C are perspective views, of an antenna sub-assembly that includes the reflector 160, the feed boards 162 and the columns of radiating elements 165 mounted thereon, as well as the calibration board/duplexer sub-assembly of FIGS. 5A-5B and 6A-6B, mounted on the guard rails 152 of the support framework 150. As shown in FIGS. 8A-8C, the calibration boards 180*a,b* may be coupled to the feed boards 162 via the board-to-board connection points 182.

Figure 9A:
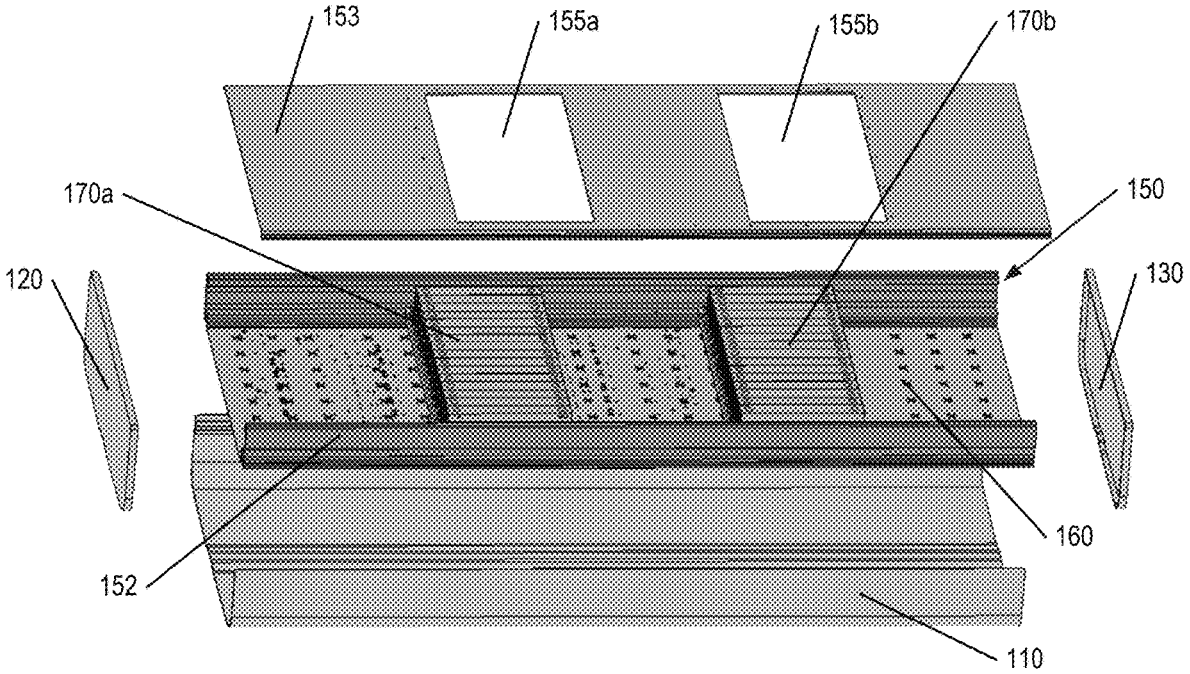
FIG. 9A is an exploded perspective view.
Figure 9B:
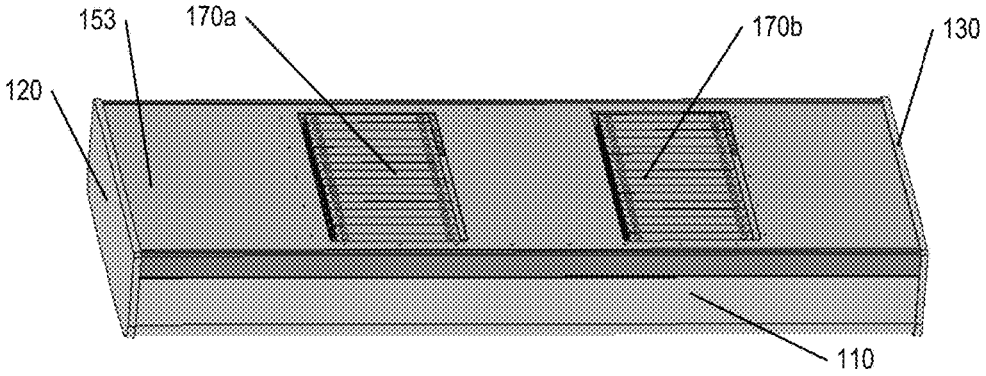
FIG. 9B is a perspective view, of the antenna and calibration board sub-assemblies of FIGS. 3 and 4 mounted within the radome and top and bottom end caps of the base station antenna.

FIGS. 9A and 9B are an exploded perspective view and a perspective view, respectively, of the antenna and calibration board/duplexer sub-assemblies mounted on the guard rails 152 of the support framework 150 enclosed by the radome 110 and top and bottom end caps 120, 130. As shown in FIGS. 9A and 9B, the end caps 120 and 130 may be separate or made integral to or monolithic with either the support framework 150 or the radome 110. The support framework 150 may include a back plate 153 that includes the openings 155*a,b* for the duplexers 170*a,b*.

Figure 10A:
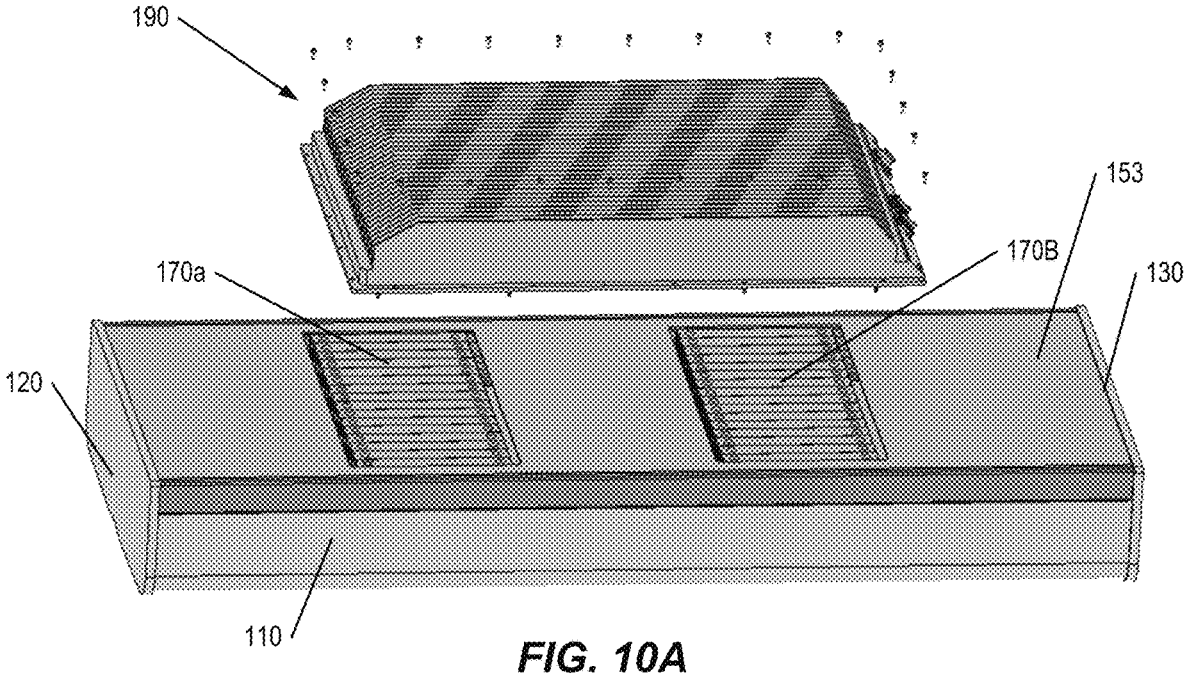
FIG. 10A is an exploded perspective view.
Figure 10B:
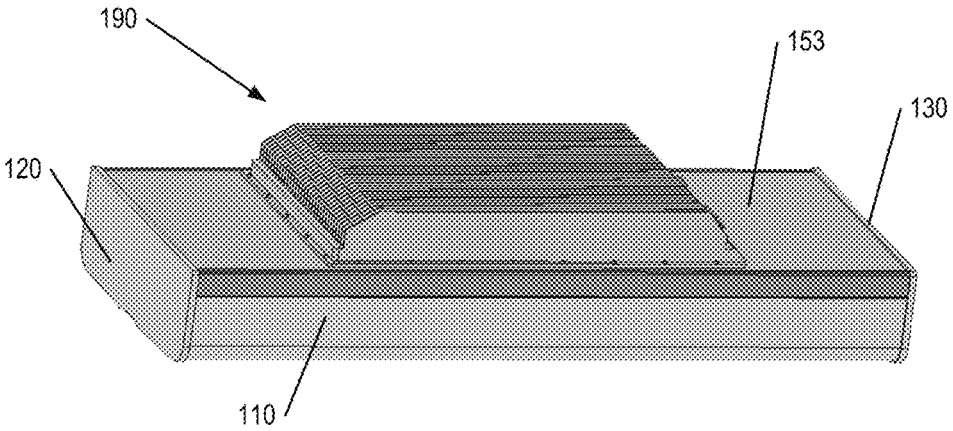
FIG. 10B is a perspective view, of the sub-assemblies of FIGS. 9A and 9B with a radio unit module mounted thereon.
Figure 10C:
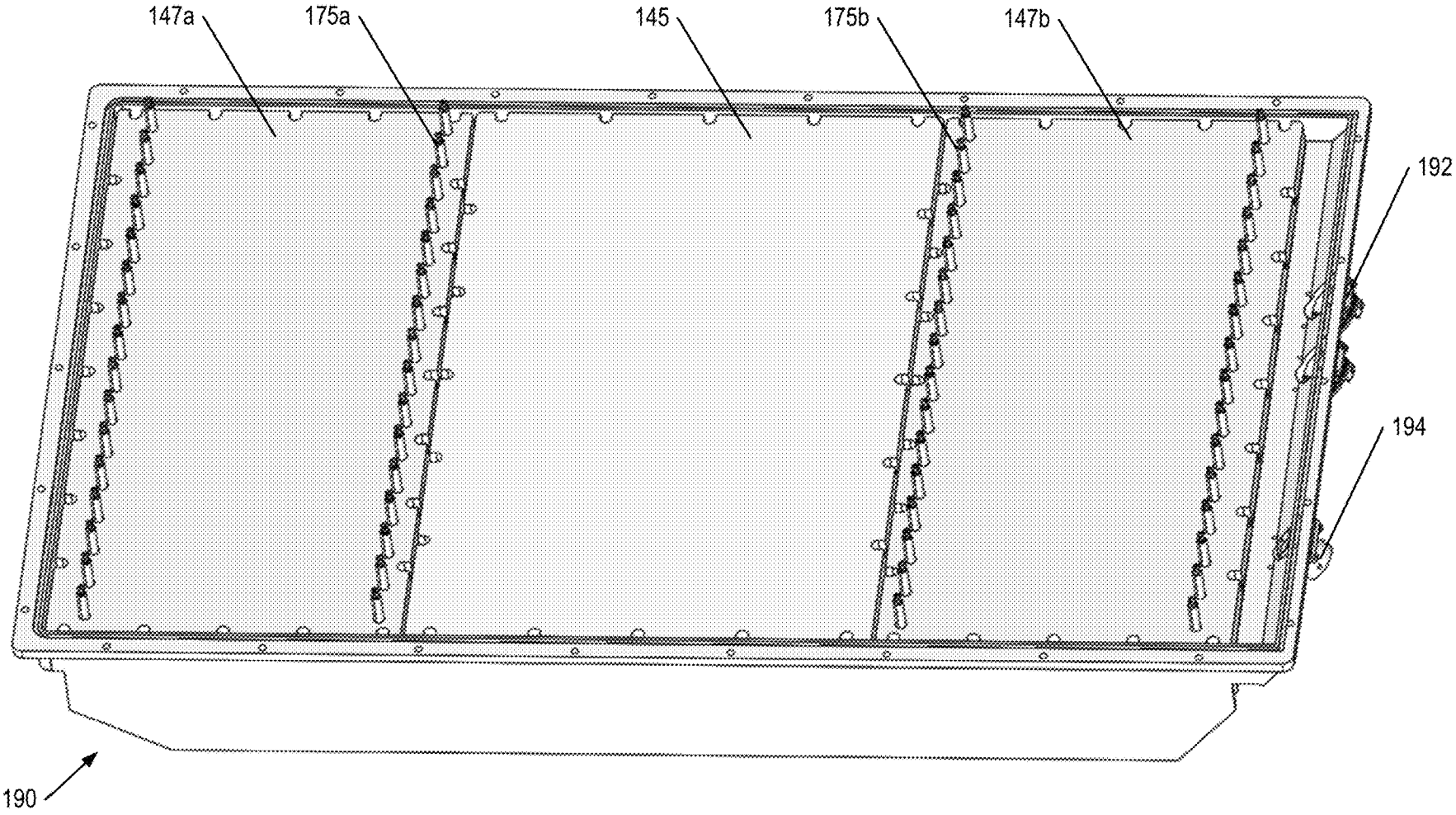
FIG. 10C is a perspective view of the radio unit module of FIGS. 9A and 9B.

FIGS. 10A and 10B are an exploded perspective view and a perspective view, respectively, of the sub-assembly of FIGS. 8A-8C with the radio unit module 140 mounted thereon according to some embodiments of the inventive concept. As shown in FIGS. 10A and 10B, the radio unit module 140 may be mounted using screws or other suitable attachment mechanisms. FIG. 10C is a perspective view of an embodiment of the radio unit module 140 mounted in a cavity within the heatsink 190. As shown in FIG. 10C, the radio unit module 140 includes the optical-to-electrical and transceiver circuitry 145, i.e., radio circuitry, along with power amplifier circuitry 147*a,b*. In the embodiments shown in FIG. 10C, the power amplifier circuitry 147*a,b* is divided into two power amplifier circuitry modules 147*a* and 147*b* with the optical-to-electrical and transceiver circuitry 145 therebetween. The power amplifier circuitry 147*a,b* includes SMP connector pins 175*a,b* for coupling to the duplexers 170*a,b*, respectively. The heatsink 190 may further include optical connectors 192 and a power connector 194 that provide electrical and optical connections between the radio module and external equipment.

Figure 11C:
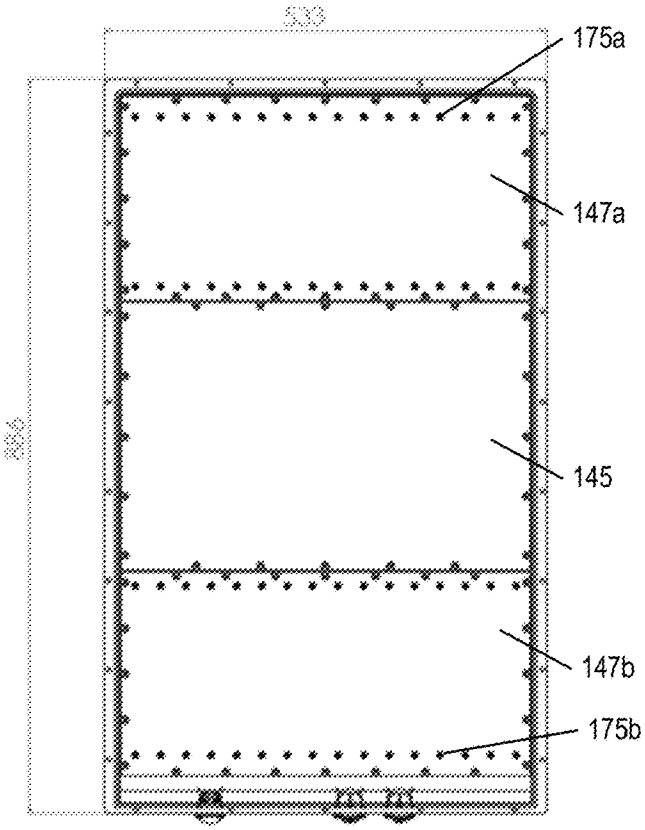
FIGS. 11A, 11B, and 11C are front, side, and back elevation views, respectively, of an integrated base station antenna radio unit module according to some embodiments of the inventive concept.
Figure 11B:
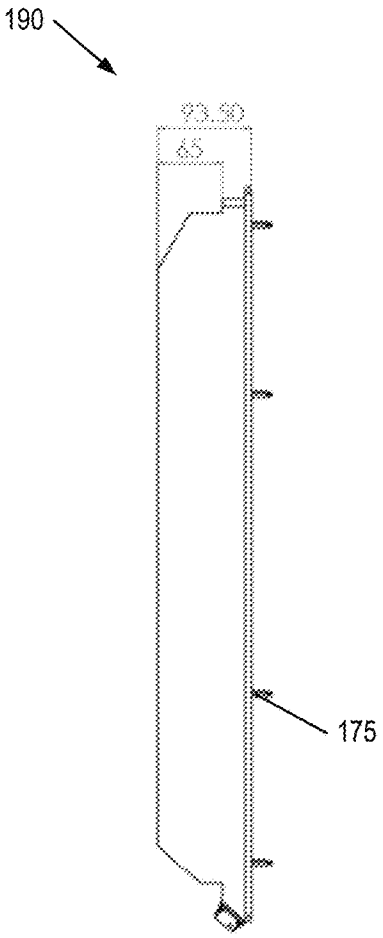
Figure 11A:
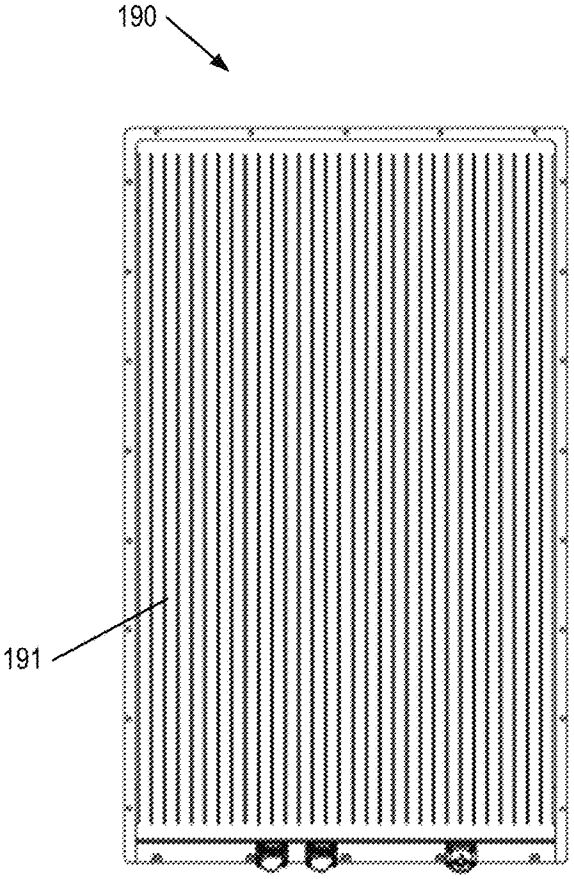

FIGS. 11A, 11B, and 11C are front, side, and back elevation views, respectively, of the heatsink 190 with the radio unit module 140 mounted therein. The fins 191 on the heatsink 190 may be configured to dissipate heat generated by the power amplifier circuitry 147*a,b* and the optical-to-electrical and transceiver circuitry 145 of the radio unit module.

Figures 12A, 12B, 12C:
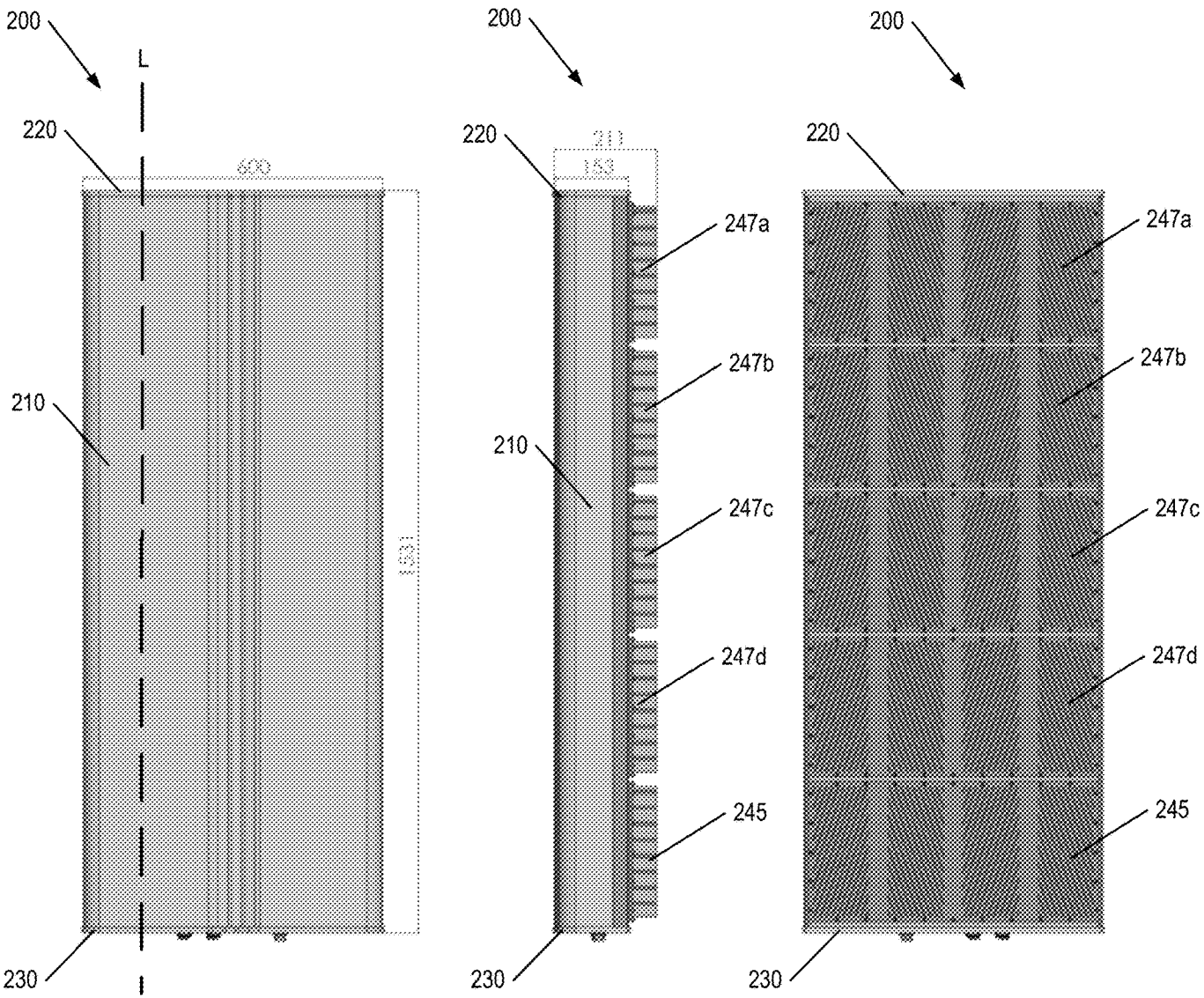
FIGS. 12A, 12B, and 12C are front, side, and back elevation views, respectively, of a modular integrated base station antenna according to some embodiments of the inventive concept.
Figure 13B:
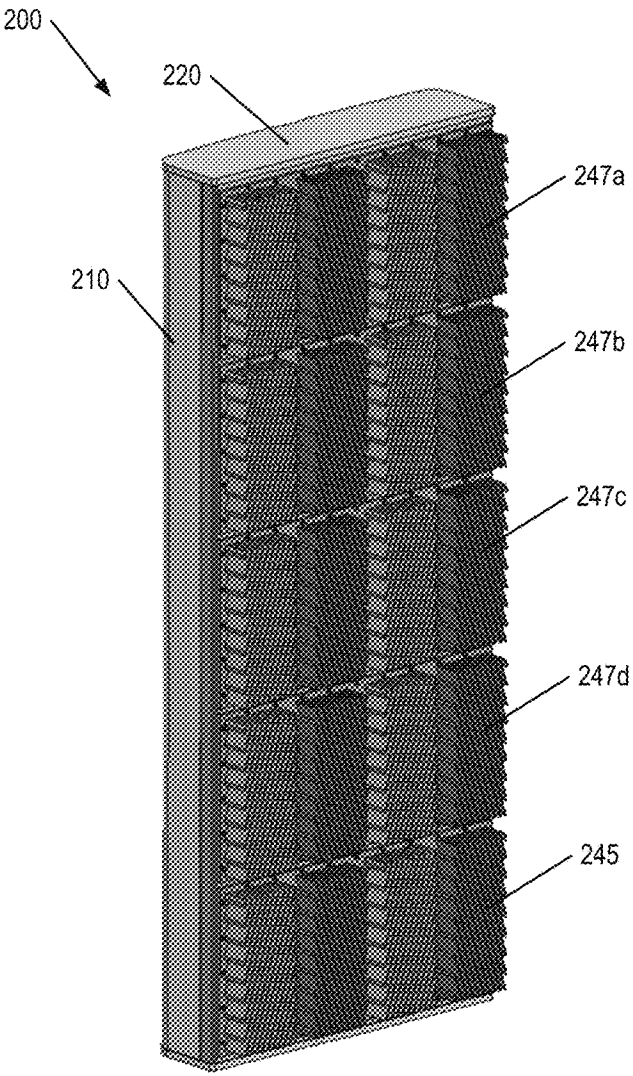
FIGS. 13A and 13B are perspective views of the integrated base station antenna of FIGS. 12A-12C.
Figure 13A:
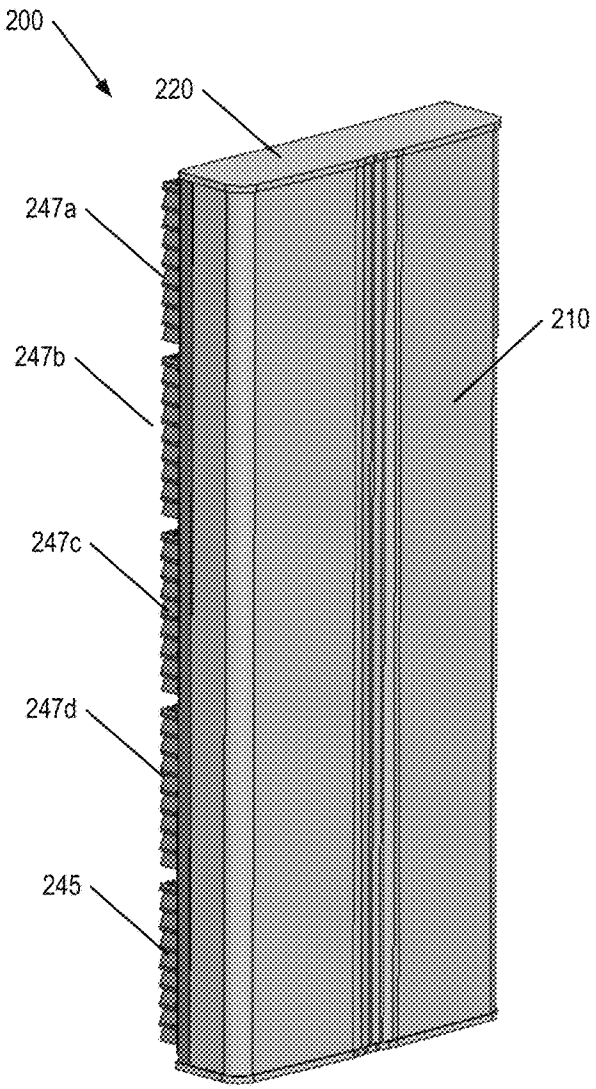

FIGS. 12A, 12B, and 12C are front, side, and back elevation views, respectively, of a modular integrated base station antenna 200, i.e., a base station antenna including integrated radio circuitry and power amplifier circuitry according to further embodiments of the inventive concept. FIGS. 13A and 13B are perspective views of the integrated base station antenna 200. In the description that follows, the antenna 200 will be described using terms that assume that the antenna 200 is mounted for use on a tower with the longitudinal axis L of the antenna 200 extending along a vertical axis and the front surface of the antenna 200 mounted opposite the tower pointing toward the coverage area for the antenna 200. In the following description, elements with analogous reference numbers to the embodiments describe above with respect to FIGS. 1A-11C signify similar or the same elements.

Referring to FIGS. 12A, 12B, 12C, 13A, and 13B, the modular integrated base station antenna 200 is an elongated structure that extends along a longitudinal axis L. The integrated base station antenna 200 may have an elongated box shape with a generally rectangular cross-section. The antenna 200 includes a radome 210, a top end cap 220 and a bottom end cap 230. The radome 210, the top end cap 220 and the bottom end cap are integrated together as a single monolithic unit in the depicted embodiment. In other embodiments, the top end cap 220 and/or the bottom end cap 230 may be separate elements and/or maybe implemented as part of a framework for supporting other elements of the modular integrated base station antenna 200. One or more mounting brackets (not shown) may be provided on the rear side of the modular integrated base station antenna 200. The modular integrated base station antenna 200 is typically mounted in a vertical configuration (i.e., the longitudinal axis L may be generally perpendicular to a plane defined by the horizon) when the integrated base station antenna 200 is mounted for normal operation. The radome 210, top cap 220 and bottom cap 230 may form part of an external housing for the integrated base station antenna 200. In contrast to the embodiments described above with respect to FIGS. 1A-11C, the modular integrated base station antenna 200 may not include a radio unit module 140 that includes both the radio circuitry 145 and the power amplifier circuitry 1470, but may instead divide these components up into individual modules including a radio circuit module 240 that includes the optical-to-electrical and transceiver circuitry 245 and multiple power amplifier circuitry modules 247*a, b,c,d*. The optical-to-electrical and transceiver circuitry 245 and the power amplifier circuitry modules 247*a,b,c,d* are coupled to the back of the modular integrated base station antenna 200. The sides and cross-member beams of the modular integrated base station antenna 200 may comprise a support framework 250 may provide structural support for various antenna assembly components, such as the duplexers and the antenna feed boards on which the columns of radiating elements are mounted.

Figure 14:
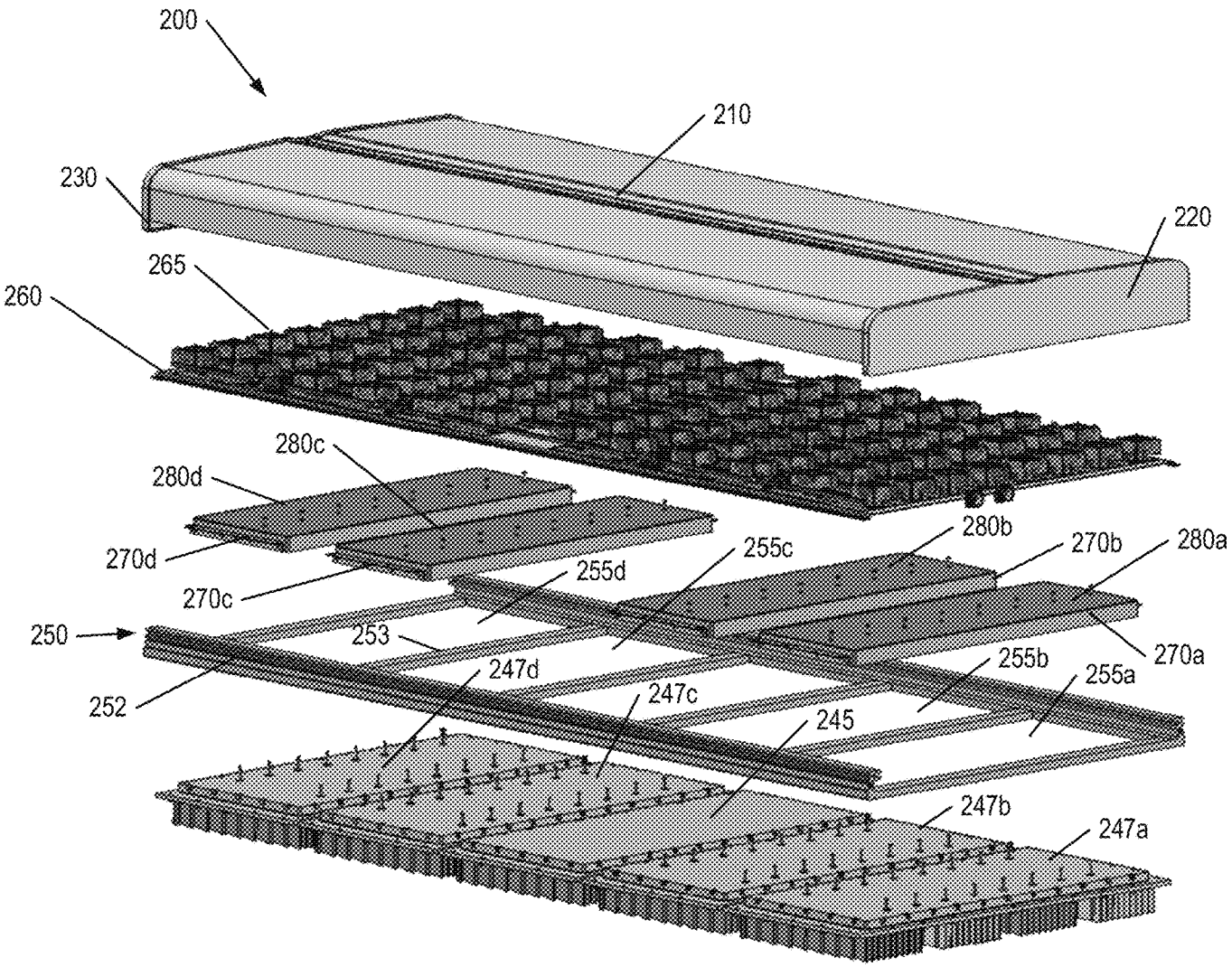
FIG. 14 is an exploded perspective view of the modular integrated base station antenna of FIGS. 12A-12C, 13A and 13B.

FIG. 14 is an exploded perspective view of the modular integrated base station antenna 200. Referring to FIG. 14, the modular integrated base station antenna 200 comprises the radome 210 including the top end cap 220 and the bottom end cap 230 and the support framework 250. A reflector 260 that includes a plurality of antenna feed boards 262 mounted thereon is provided between the support framework 250 and the radome 210. Each feed board 262 has a plurality of columns of radiating elements 265 mounted thereon.

As shown in FIG. 14, the support framework 250 may include openings 255 therein through which to allow the power amplifier circuitry in the respective power amplifier circuitry modules 247*a,b,c,d* connect to the duplexers 270. As will be described hereinafter, the duplexers 270*a,b,c,d* may be received in the support framework 250 via the guard rails 252 and may respectively couple to the power amplifier circuitry in the power amplifier modules 247*a,b,c,d* through the openings 255*a,b,c,d*. The radio circuit module 245 may include optical-to-electrical and transceiver circuitry, i.e., radio circuitry. One or more remote electronic tilt actuator assemblies may be mounted in the space above the radio circuit module 245 next to other duplexers 270*a,b,c,d* in some embodiments of the inventive concept.

Figure 15A:
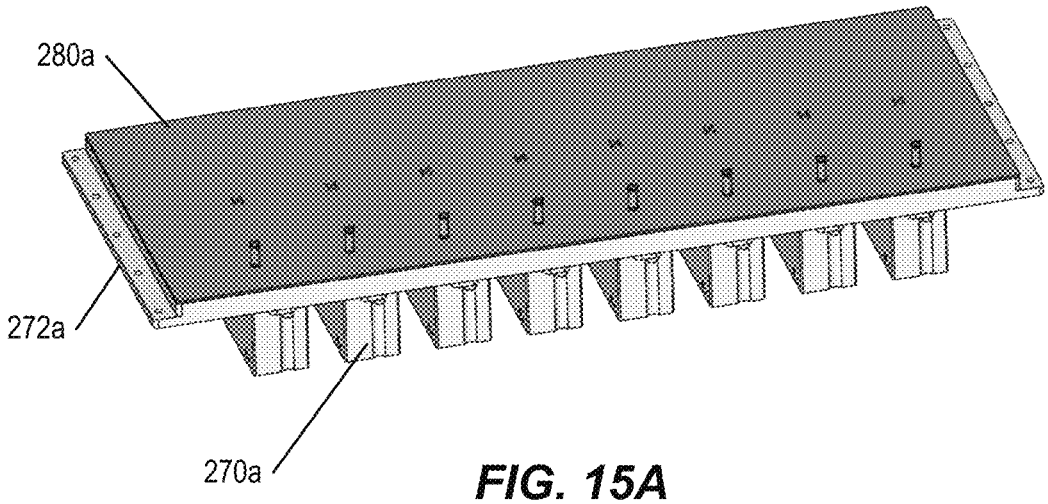
FIGS. 15A and 15B are perspective views of a calibration board/duplexer sub-assembly of the modular integrated base station antenna of FIG. 14.
Figure 15B:
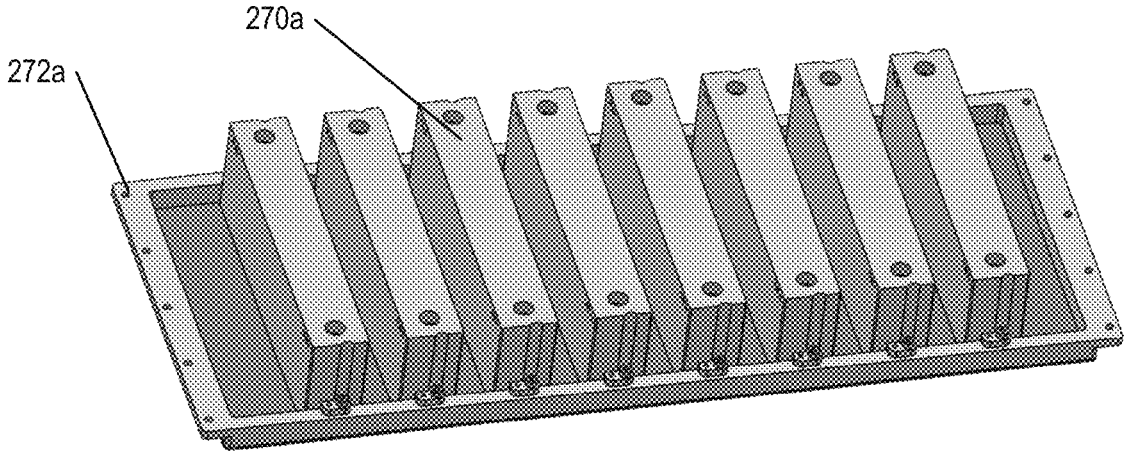

FIGS. 15A and 15B are perspective views of a calibration board/duplexer sub-assembly according to some embodiments of the inventive concept that includes a calibration board 280 and the duplexers 270*a*. As shown in FIGS. 14, 15A, and 15B, the calibration board 280 is coupled to the duplexers 270*a* via a base plate 272*a*. The calibration board 280 may include board-to-board connection points 282 for connecting to the feed boards 262 and male SMP pin connectors for connecting to female SMP connectors on the duplexers 270*a*.

Figure 16:
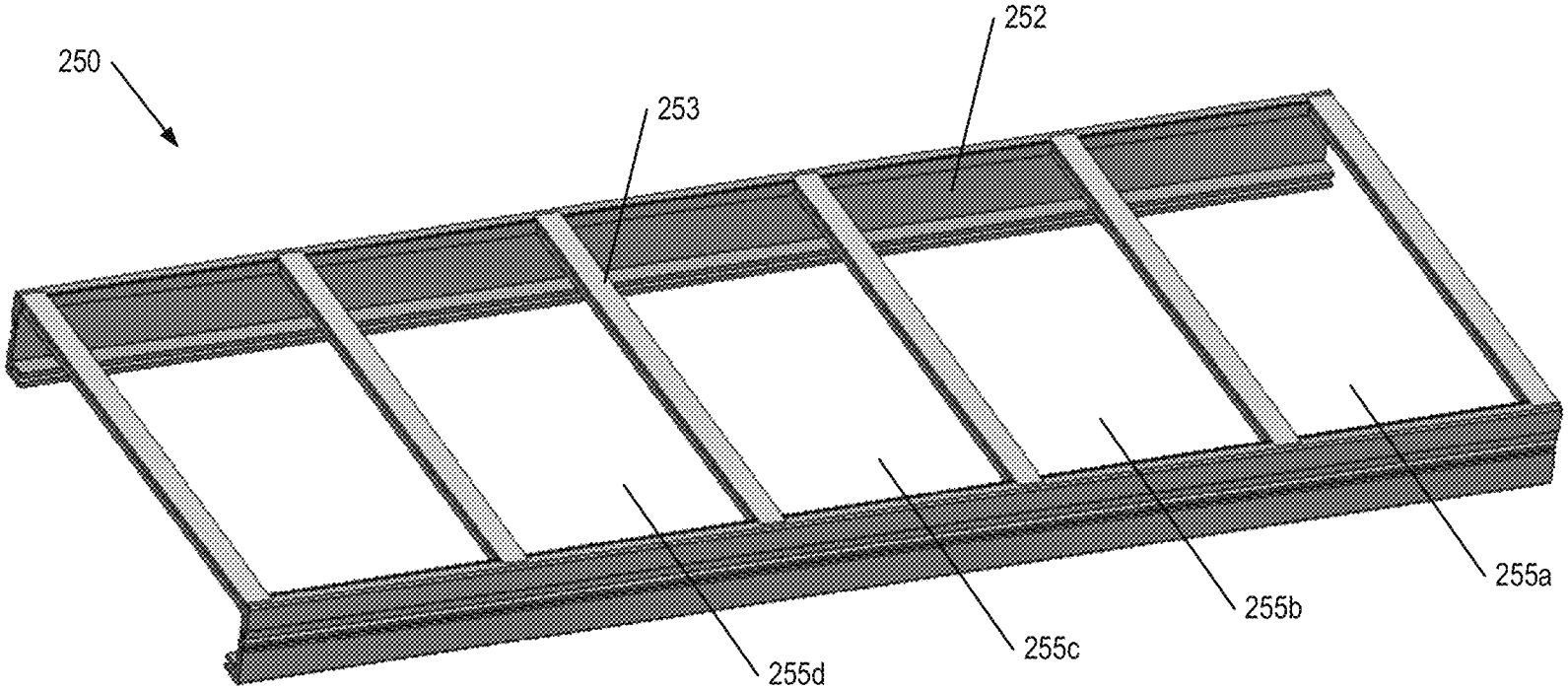
FIG. 16 is perspective view of the support framework of the modular integrated base station antenna FIG. 14.

FIG. 16 is perspective view of the support framework 250 according to some embodiments of the inventive concept. As shown in FIGS. 14 and 16, the support framework 250 includes guard rails 252 and cross-member beams 253 in place of the back plate 153 described above. The cross-member beams 253 may define the openings 255*a,b,c,d* in the support framework.

Figure 17A:
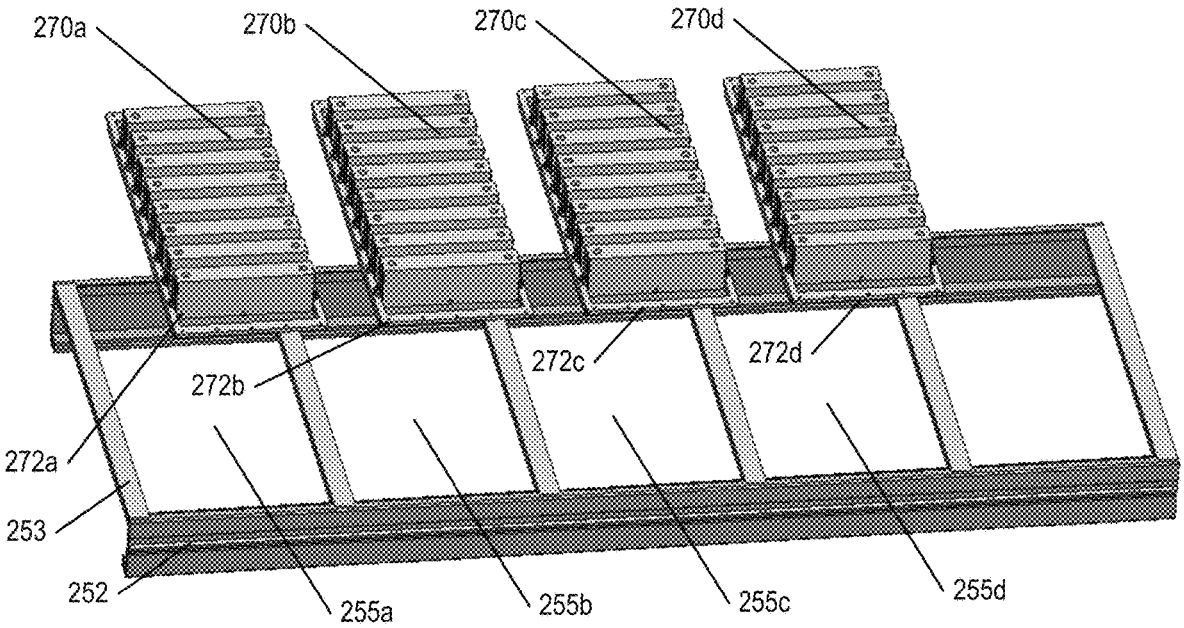
FIG. 17A is an exploded perspective view.
Figure 17B:
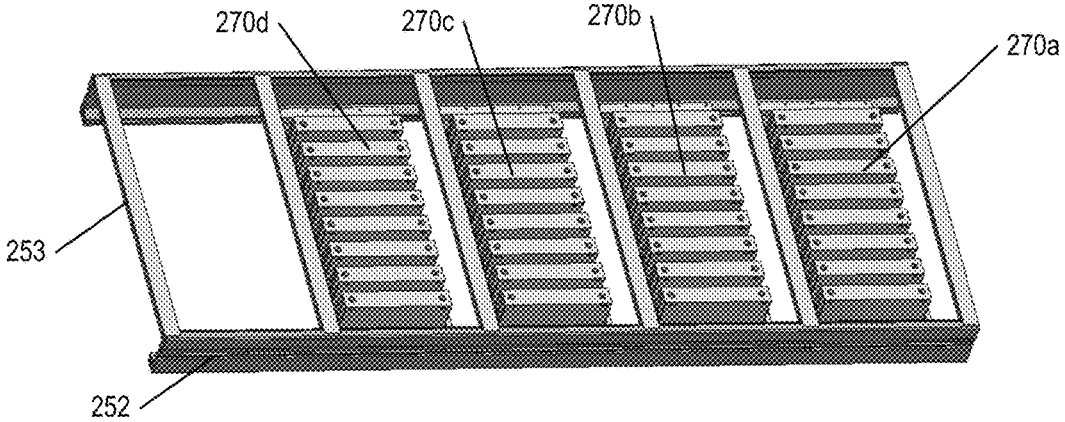
FIGS. 17B and 17C are perspective views, of the calibration board/duplexer sub-assembly of the modular integrated base station antenna FIG. 14.
Figure 17C:
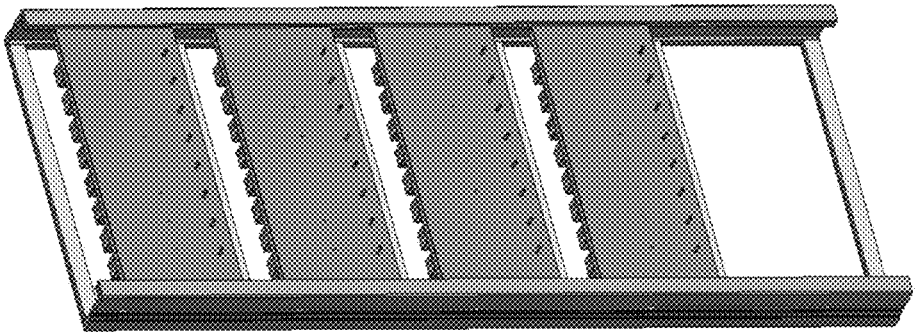

FIG. 17A is an exploded perspective view, and FIGS. 17B and 17C are perspective views, of the calibration board/duplexer sub-assembly of FIGS. 15A-15B mounted on the guard rails 252 of the support framework 250. As shown in FIGS. 14 and 17A-17C, the base plates 272*a,b,c,d* of the calibration boards 280*a,b,c,d* may be used to attach the sub-assembly of the duplexers 270*a,b,c,d* and calibration boards 280*a,b,c,d* to the guard rails 252 using screws or another suitable attachment mechanism.

Figure 18A:
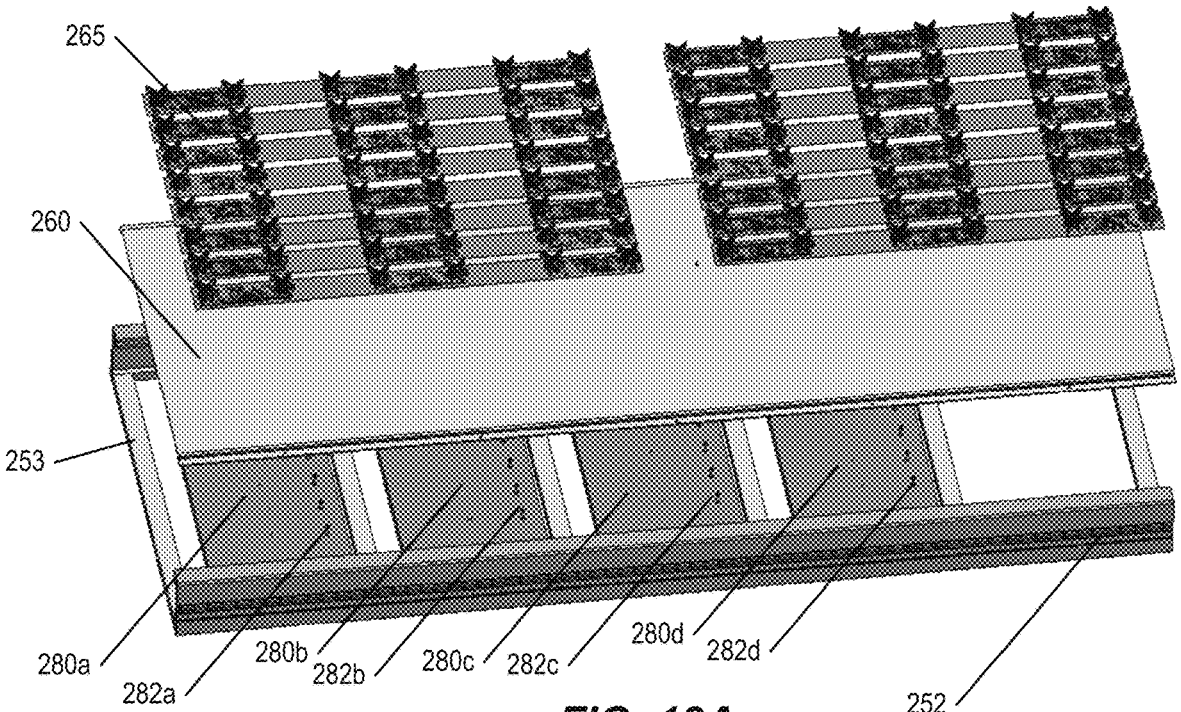
FIG. 18A is an exploded perspective view.
Figure 18B:
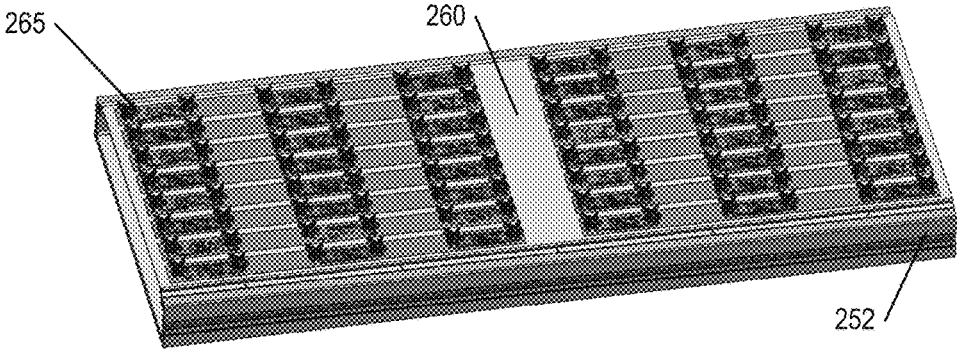
FIGS. 18B and 18C are perspective views, of the antenna and calibration board/duplexer sub-assemblies of the modular integrated base station antenna of FIG. 14.
Figure 18C:
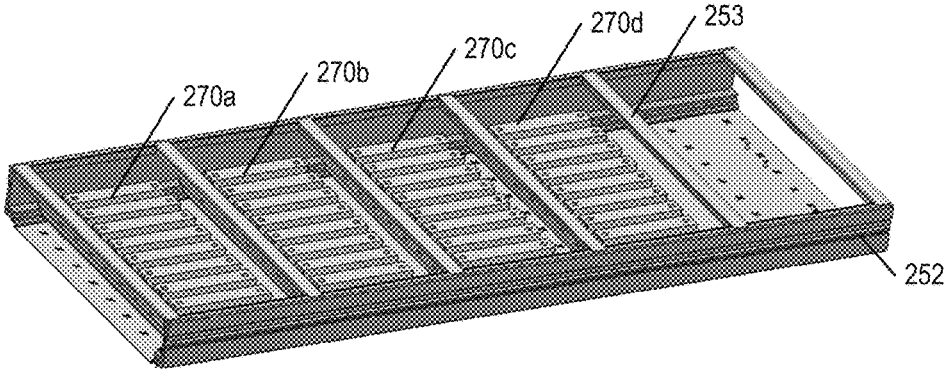

FIG. 18A is an exploded perspective view, and FIGS. 18B and 18C are perspective views, of the antenna and calibration board/duplexer sub-assemblies mounted on the guard rails 252 of the support framework 250. The antenna sub-assembly includes columns of radiating elements 265, the feed boards 262 and the reflector 260. As shown in FIGS. 14 and 18A-18C, the calibration boards 280*a,b,c,d* may be coupled to the feed boards 262 via the board-to-board connection points 282.

Figure 19A:
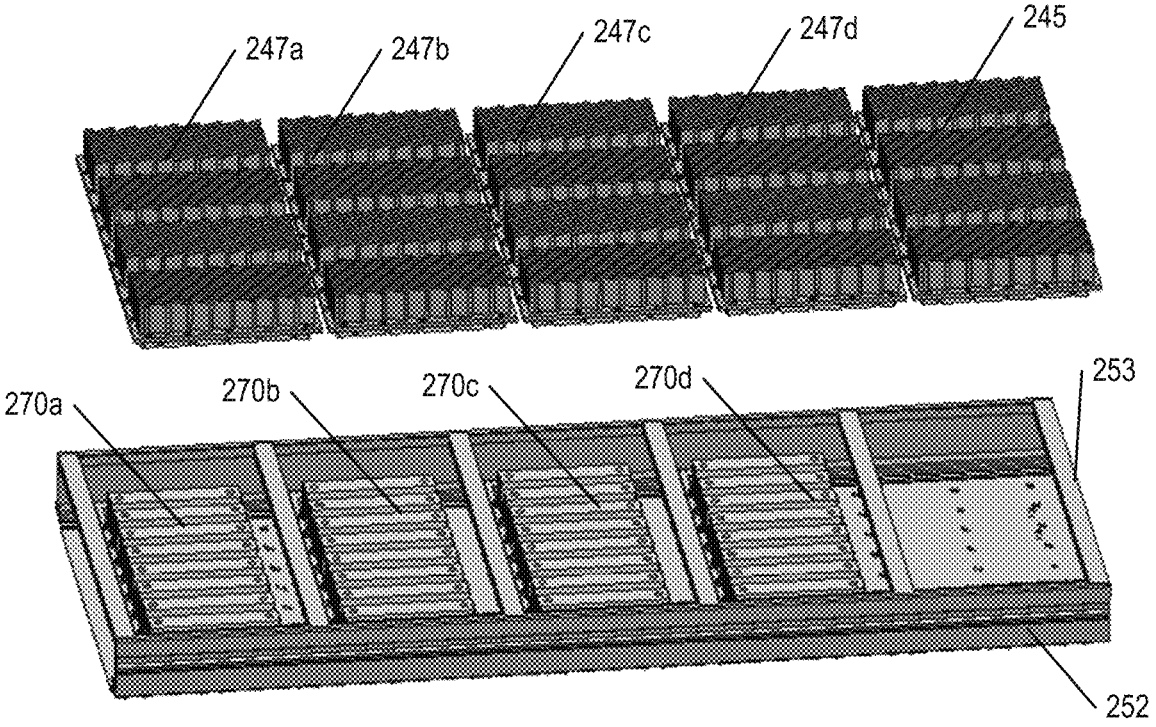
FIG. 19A is an exploded perspective view.
Figure 19B:
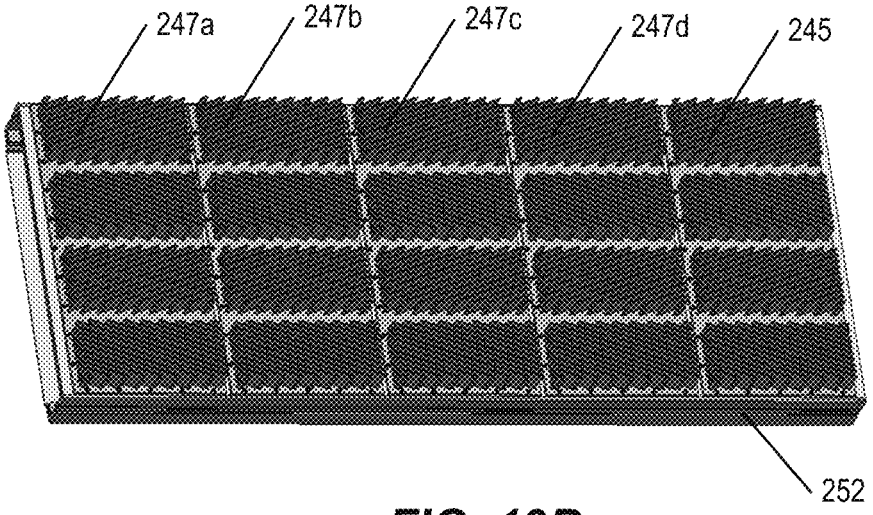
FIG. 19B is a perspective view, of the radio and power amplifier circuitry modules of the modular integrated base station antenna of FIG. 14.

FIG. 19A is an exploded perspective view, and FIG. 19B is a perspective view, of the sub-assembly of the radio circuit module 245 and the power amplifier circuitry modules 247*a,b,c,d* coupled to the support framework 250. As shown in FIGS. 14, 19A, and 19B, the radio circuit module 245 and the power amplifier circuitry modules 247*a,b,c,d* may be coupled to the support framework 250 along the guard rails 252 and the cross-member beams 253 using screws or another suitable attachment mechanism, such that the power amplifier circuitry modules 247*a,b,c,d* align with the duplexers 270*a,b,c,d*, respectively. The connections between the duplexers 270*a,b,c,d* and the power amplifier circuitry 247*a,b,c,d* modules may be SMP pin connections.

Figure 20:
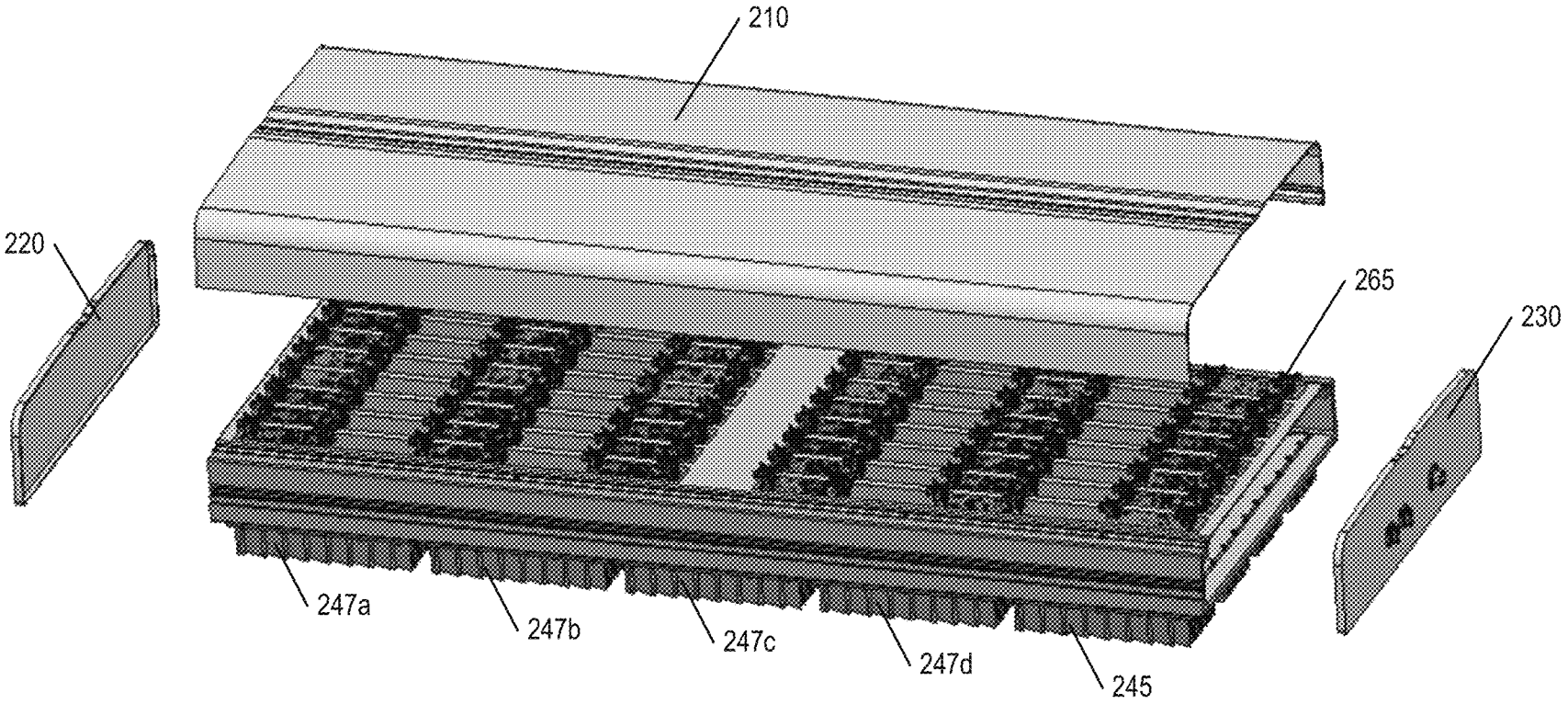
FIG. 20 is an exploded perspective view of the sub-assemblies of FIGS. 19A and 19B enclosed in a radome.

FIG. 20 is an exploded perspective view of the sub-assembly of FIGS. 19A and 19B enclosed in the radome 110.

As shown in FIG. 20, the end caps 220 and 230 may be separate or made integral to or monolithic with either the support framework 250 or the radome 210.

Figure 21A:
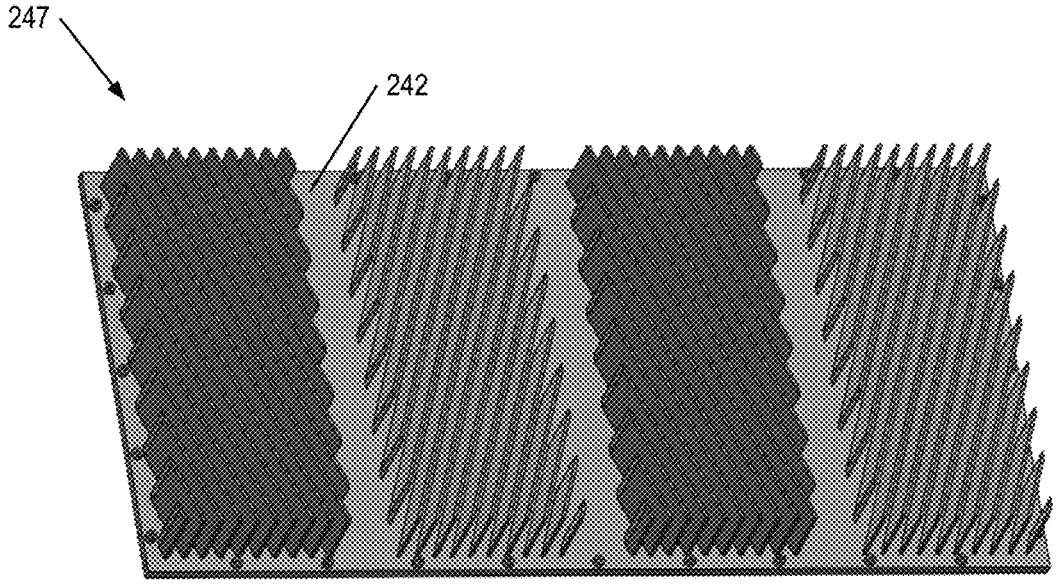
FIGS. 21A and 21B are perspective views of the power amplifier circuitry module of the modular integrated base station antenna of FIG. 14.
Figure 21B:
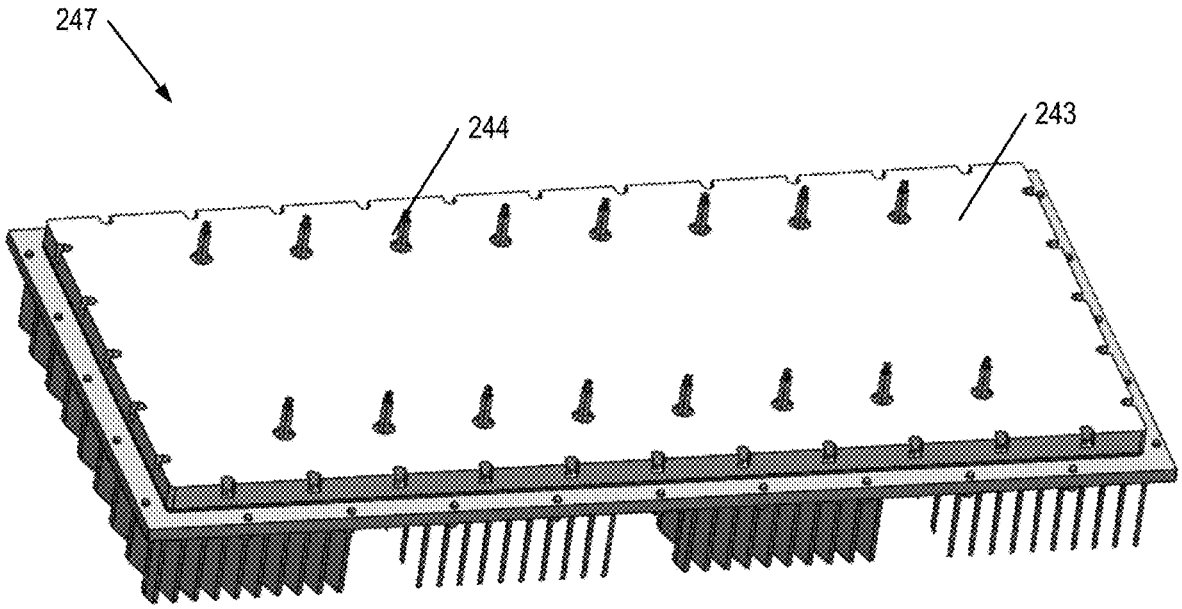

FIGS. 21A and 21B are perspective views of a power amplifier circuitry module 247 according to some embodiments of the inventive concept. As shown in FIG. 21A, an outer surface 242 of the power amplifier circuitry module 247 may comprise a heatsink and include fins extending therefrom that are angled in different directions so as to improve air flow over the power amplifier circuitry module 247 to enhance the cooling of amplifiers contained therein. A bottom surface 243 of the power amplifier circuitry module 247 may include SMP pins 244 for coupling the power amplifier circuitry module 247 to a duplexer module 270. In other embodiments, a separate heatsink may be provided and the radio circuit module 240 may be mounted on or in the separate heatsink.

Figure 22:
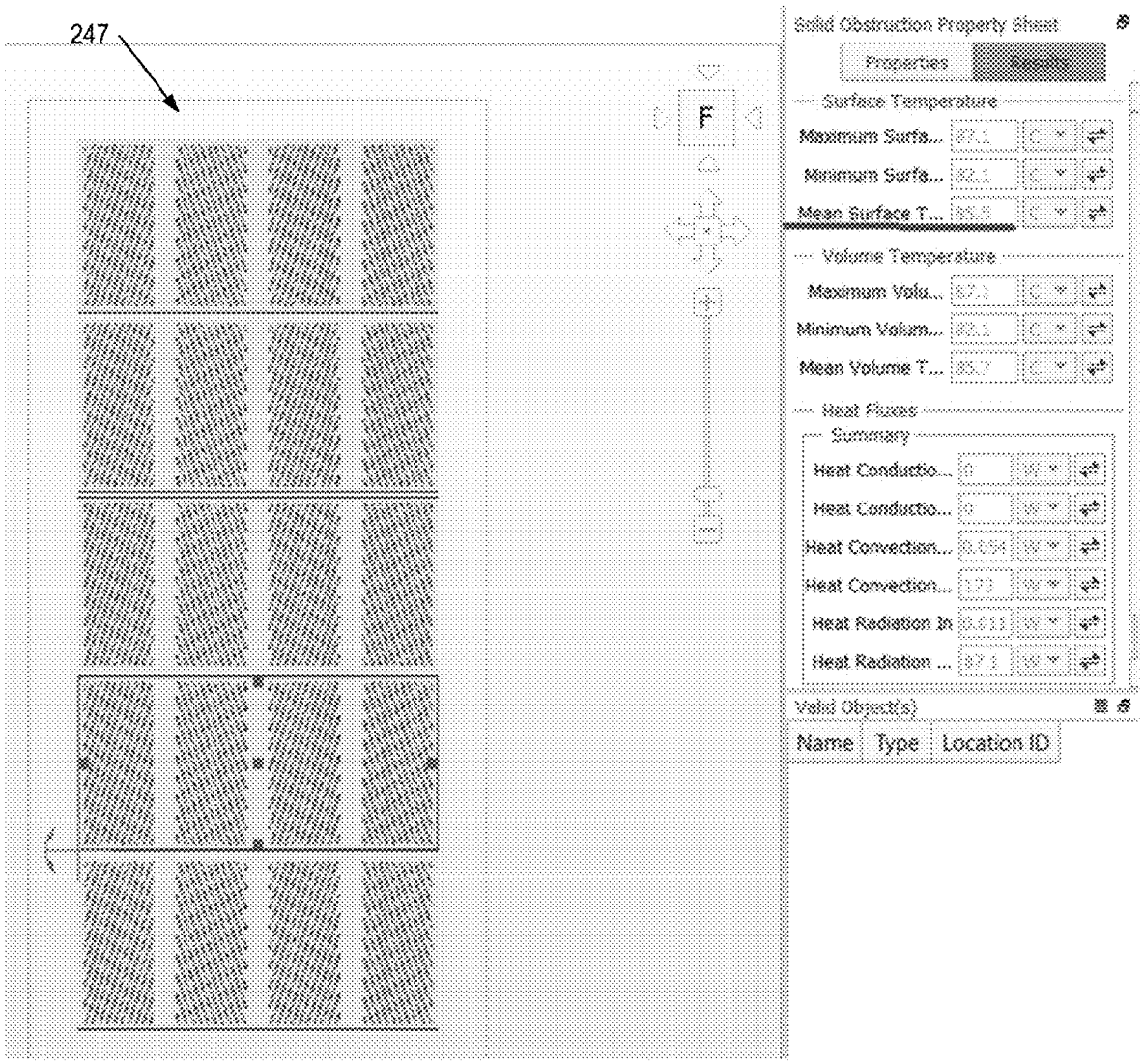
FIGS. 22 and 23 are simulation results illustrating the dissipation of heat by the heatsink of the power amplifier circuitry module of the modular integrated base station antenna of FIG. 14.
Figure 23:
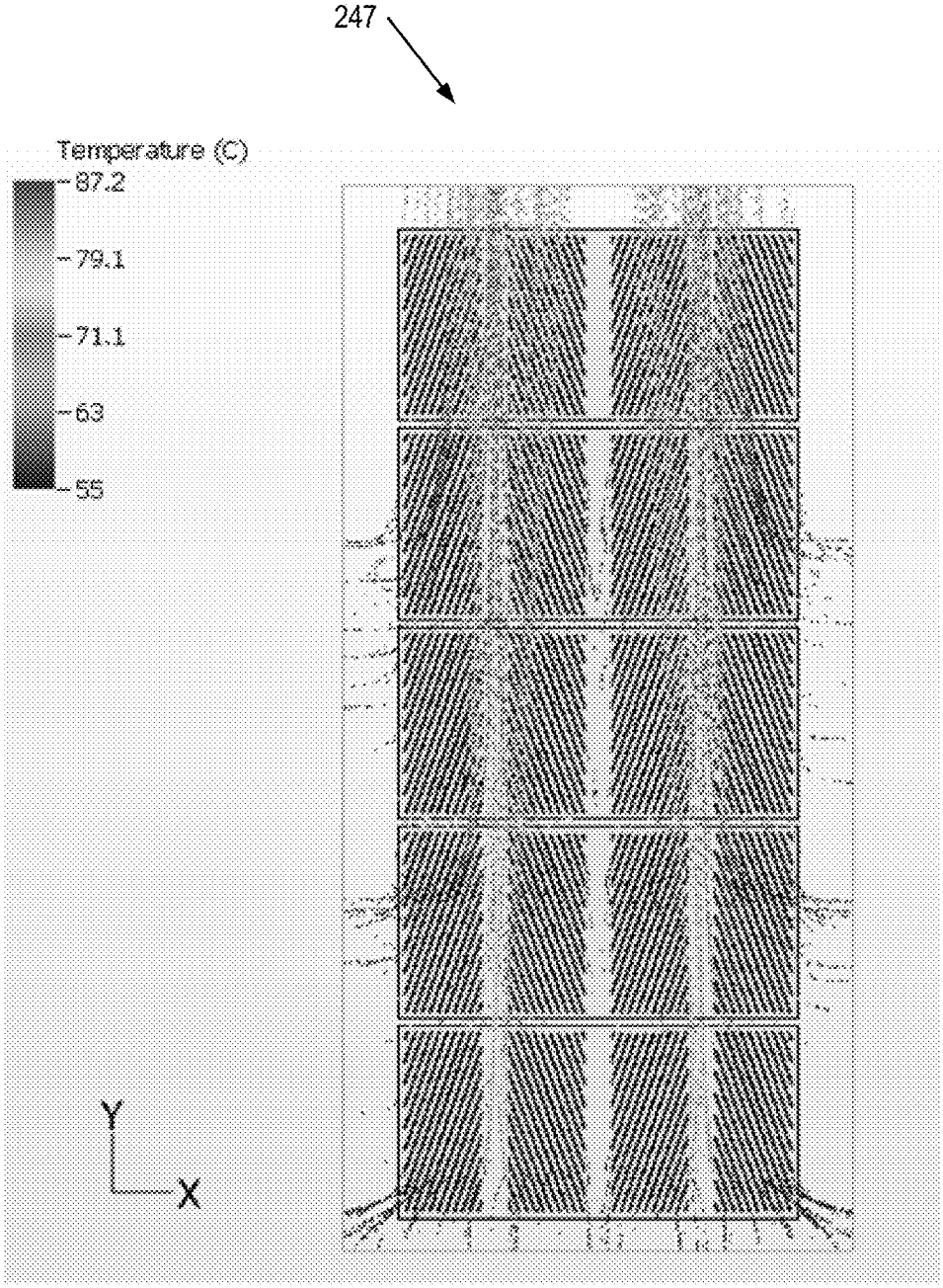

FIGS. 22 and 23 are results of a thermal simulation that illustrate the dissipation of heat due to the fin configuration on the outer surface 242 of the power amplifier circuitry module 247. As shown in FIG. 22, the mean temperature of the heatsink provided by the outer surface 242 of the power amplifier circuitry module 247 is about 85.5 degrees Celsius. As shown in FIG. 23, air entering from the top (Y-axis) of the power amplifier circuitry module 247 may be directed in positive and negative horizontal (X-axis) directions away from the power amplifier circuitry module 247.

Similar to the embodiments described above with respect to FIGS. 1A-11C, the connections between the feed boards 262 and the calibration boards 280*a,b,c,d* may be a board-to-board connection using connection points 282 on each of the calibration boards 280*a,b,c,d*, the connections between the calibration boards 280*a,b,c,d* and the duplexers 270*a,b,c,d* may each be SMP pin connections, and the connections between the duplexers 270*a,b,c,d* and the power amplifier circuitry 247*a,b,c,d* modules may also be SMP pin 175 connections. These board-to-board connections and SMP pin connections may replace cables, which can improve electrical performance by reducing PIM and also make for a more compact assembly. Moreover, the elimination of cables at the calibration boards 280 may improve the accuracy in evaluating signal phase as cabling may introduce some phase error due to its length.

In some embodiments, phase shifters along with their associated mechanical control mechanisms may be implemented on the feed boards 262 on the radiating element 265 side of the reflector 260. This may eliminate the need for phase cables between the radiating elements 265 and separate phase shifter assemblies, providing yet further improvements to PIM performance and more compactness in the overall assembly.

The embodiments of FIGS. 12A-23 may further provide a modular integrated base station antenna in which the radio circuitry and power amplifier circuitry is mounted on a plurality of separate support surfaces instead of being placed on a single monolithic support surface. Separate heat sinks may be used for each of the plurality of surfaces, which may improve the ability to isolate thermal hot spots due to the division of the radio circuitry and power amplifier circuitry. A single heat sink surface may allow heat to build to unacceptable levels in some locations.

The modularity of the embodiments of FIGS. 12A-23 including the multiple power amplifier circuitry modules 247*a,b,c,d*, separate radio circuitry module 245, and duplexer modules 270*a,b,c,d* may allow for easier configuration of the antenna to include more or less receive and transmit paths. For example, power amplifier circuitry modules and duplexer modules may be removed to convert the antenna from a 32T32R type antenna to a 16T16R type antenna.

Figure 35:
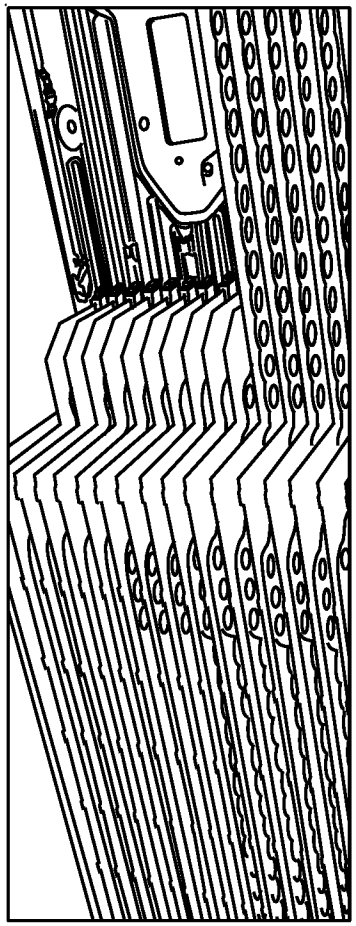
FIG. 35 is a pair of photographs that show the front and rear of an example phase change heat sink that may be used in the integrated base station antennas according to embodiments of the inventive concept.
Figure 35:
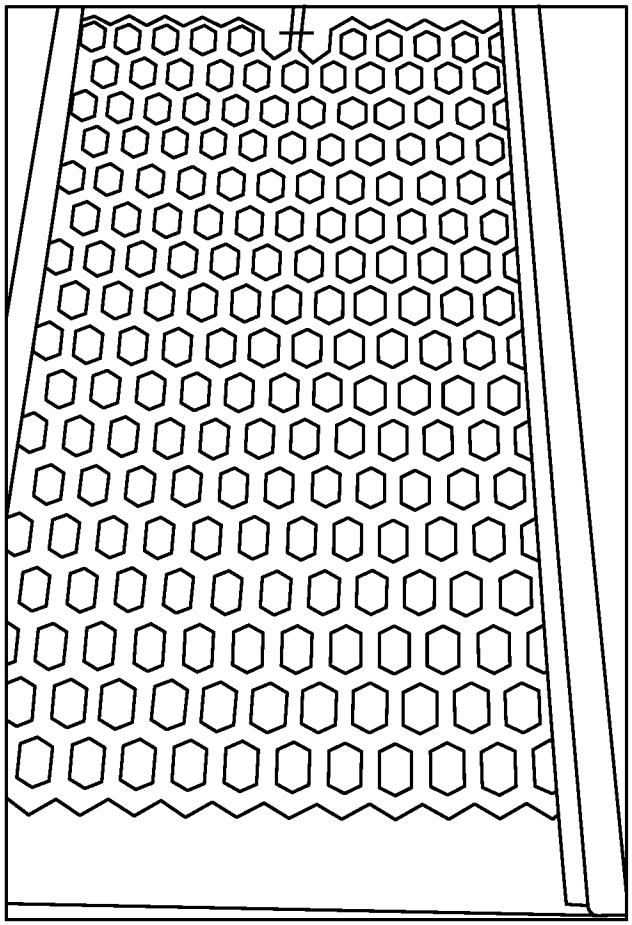

While FIGS. 12A-23 illustrate an example embodiment in which an outer surface 242 of each power amplifier circuitry module 247 and the outer surface of the radio circuit module 245 are formed as separate heatsinks that include fins extending therefrom, it will be appreciated that other arrangements are possible. For example, in some embodiments, the heatsinks may be separate from the power amplifier circuitry modules 247 and/or may be separate from the radio circuit module 245. Additionally, the heat sinks need not be modular. For example, in another embodiment, a single heatsink such as, for example, an extruded fin-type heatsink, may be provided that serves as the heatsink for all four power amplifier circuitry modules 247. The radio circuit module 245 may have its own heatsink. In some embodiments, the radio circuit module 245 may have an extruded heatsink. In other embodiments, a phase change heatsink may be coupled to the radio circuit module 245 that is separate from, and potentially spaced apart from, an extruded heatsink that is mounted behind all four of the power amplifier circuitry modules 247. The majority of the heat that is generated in the radio circuit module 245 may be generated by a small number of chipsets included therein. A phase change heatsink may be very effective in dissipating heat in such a situation. FIG. 35 is a pair of photographs that show the front and rear of an example phase change heat sink that could be mounted behind the radio circuit module 245. In still other embodiments, a phase change heat sink may be mounted behind the power amplifier circuitry modules 247. For example, a single large phase change heatsink or five individual phase change heatsinks may be mounted behind the radio circuit module 245 and the power amplifier circuitry modules 247.

Figure 24A:
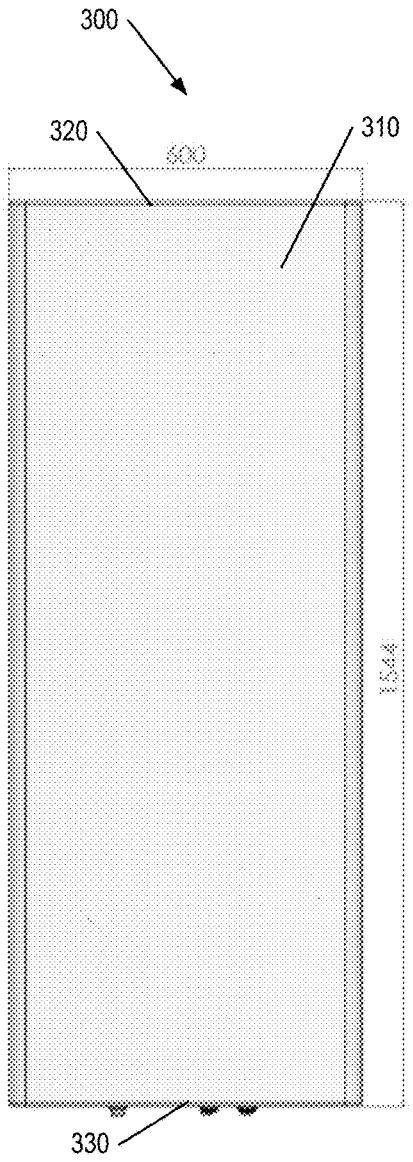
FIGS. 24A, 24B, and 24C are front, side, and back elevation views, respectively, of an integrated base station antenna according to further embodiments of the inventive concept.
Figure 24B:
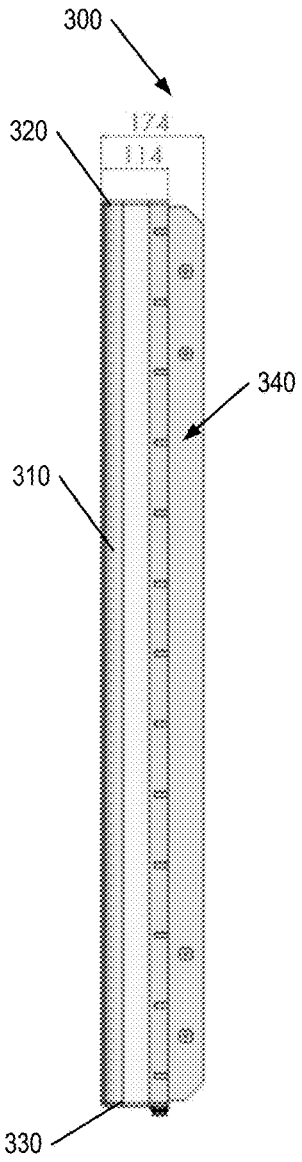
Figure 24C:
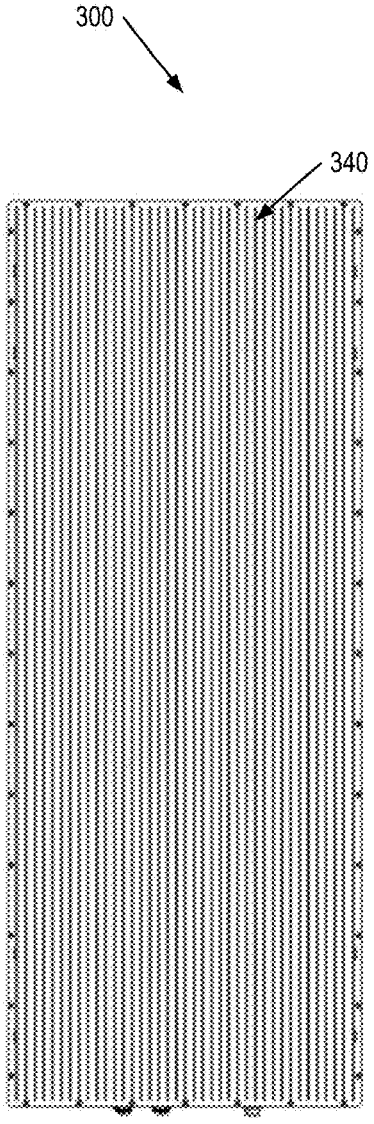
Figure 25A:
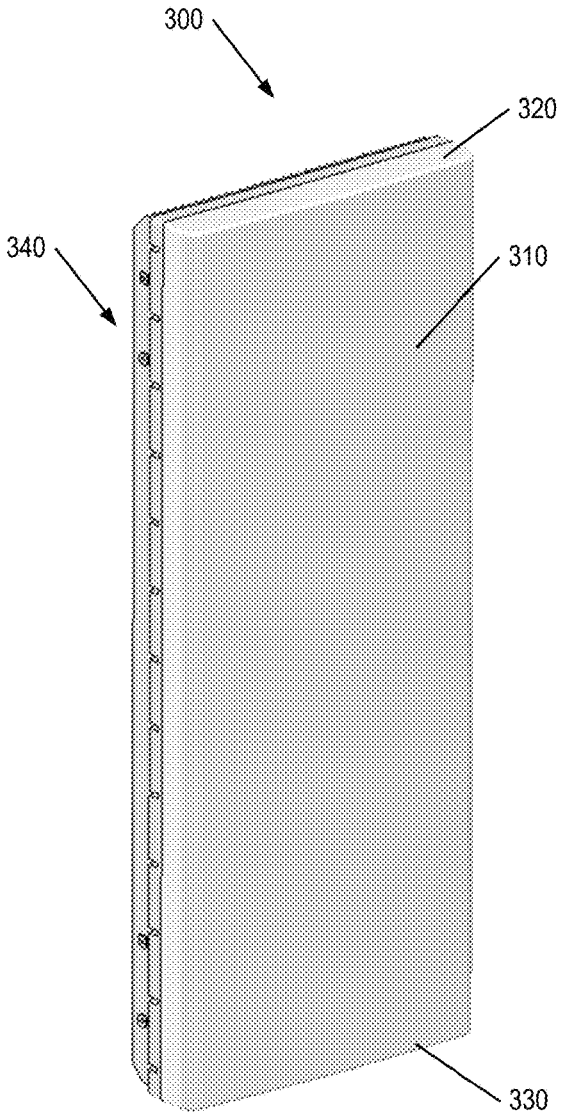
FIGS. 25A and 25B are perspective views of the integrated base station antenna of FIGS. 24A-24C.
Figure 25B:
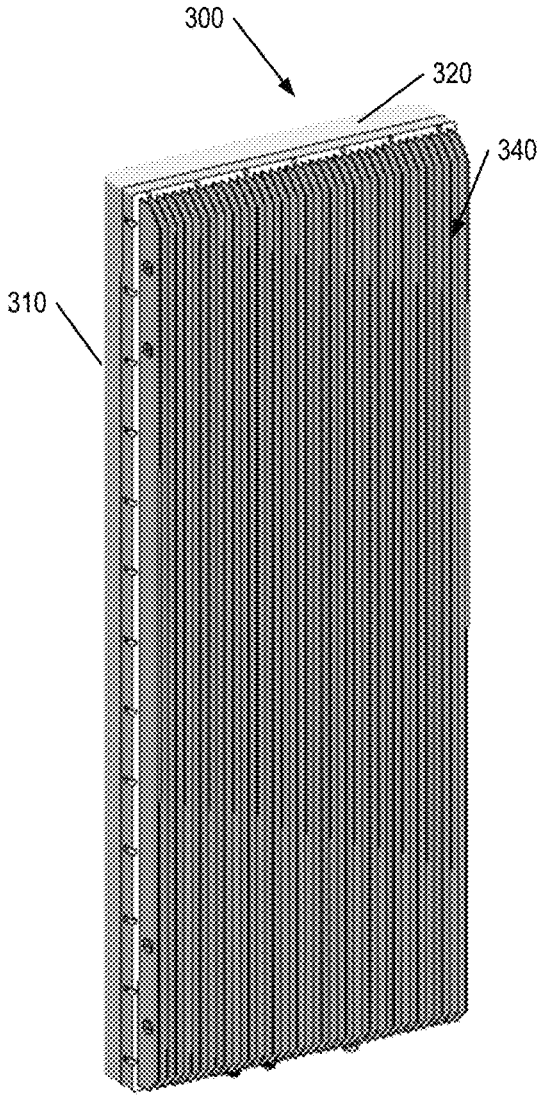

FIGS. 24A, 24B, and 24C are front, side, and back elevation views, respectively, of an integrated base station antenna 300, i.e., a base station antenna including integrated radio circuitry and power amplifier circuitry according to still further embodiments of the inventive concept. FIGS. 25A and 25B are perspective views of the integrated base station antenna 300. In the description that follows, the antenna 300 will be described using terms that assume that the antenna 300 is mounted for use on a tower with the longitudinal axis L of the antenna 300 extending along a vertical axis and the front surface of the antenna 300 mounted opposite the tower pointing toward the coverage area for the antenna 300. In the following description, elements with analogous reference numbers to the embodiments describe above with respect to FIGS. 1A-23 signify similar or the same elements Referring to FIGS. 24A, 24B, 24C, 25A, and 25B, the integrated base station antenna 300 may have an elongated box shape with a generally rectangular cross-section. The antenna 300 includes a radome 310 a top end cap 320 and a bottom end cap 330. The top and bottom end caps 320, 330 may, for example, be part of a framework for supporting other elements of the integrated base station antenna 300. One or more mounting brackets (not shown) may be provided on the rear side of the integrated base station antenna 300. The integrated base station antenna 300 is typically mounted in a vertical configuration. The radome 310, top cap 320 and bottom cap 330 may form an external housing for the integrated base station antenna 300. The integrated base station antenna 300 may further include a radio unit module 340 that is coupled to the back of the integrated base station antenna 300, which may include the radio circuitry and power amplifier circuitry therein. The sides and back of radio unit module 340 may comprise a support framework that may provide structural support for various antenna assembly components, such as the duplexers, the reflector and the antenna feed boards on which the columns of radiating elements are mounted.

Figure 26:
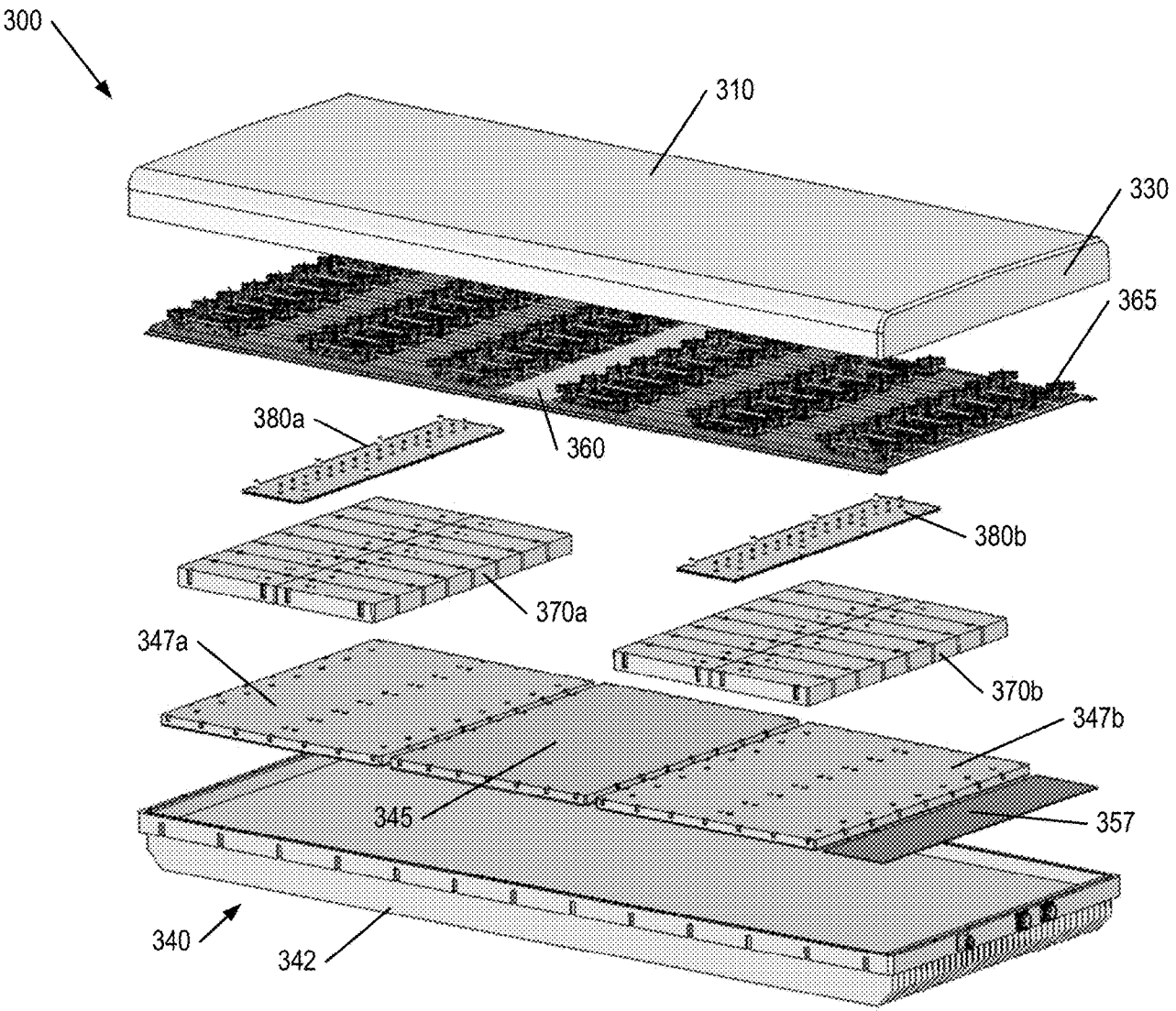
FIG. 26 is an exploded perspective view of the integrated base station antenna of FIGS. 24A-24C, 25A, and 25B.

FIG. 26 is an exploded perspective view of the integrated base station antenna 300. Referring to FIG. 26, the integrated base station antenna 300 comprises the radome 310 including the top end cap 320 and the bottom end cap 330. A plurality of antenna feed boards 362 are mounted on a reflector 360. Each feed board 362 includes a plurality of radiating elements 365 mounted thereon. The calibration boards 380*a,b* are connected to the antenna feed boards 362. The two calibration boards 380*a,b* are mounted on duplexers 370*a,b*, respectively, which in turn are mounted on power amplifier circuitry modules 347*a,b*, respectively. This sub-assembly is received into the radio unit module 340 housing 342, which may function as a heatsink. Optical-to-electrical and transceiver circuitry 345, i.e., radio circuitry is mounted between the two power amplifier circuitry modules 347*a,b*. Thus, the integrated base station antenna 300 differs from the integrated base station antenna 100 in that a support framework 150 is not included and the duplexers 370*a,b*, are oriented so as to place eight duplexers back to back rather than sixteen duplexers in a row. The calibration boards 380*a,b* may be made narrower than the calibration boards 180*a,b* as the calibration boards 380*a,b* may cover the interface between the two groups of eight duplexers rather than the entire length of a group of sixteen duplexers arranged in a row.

Figure 27:
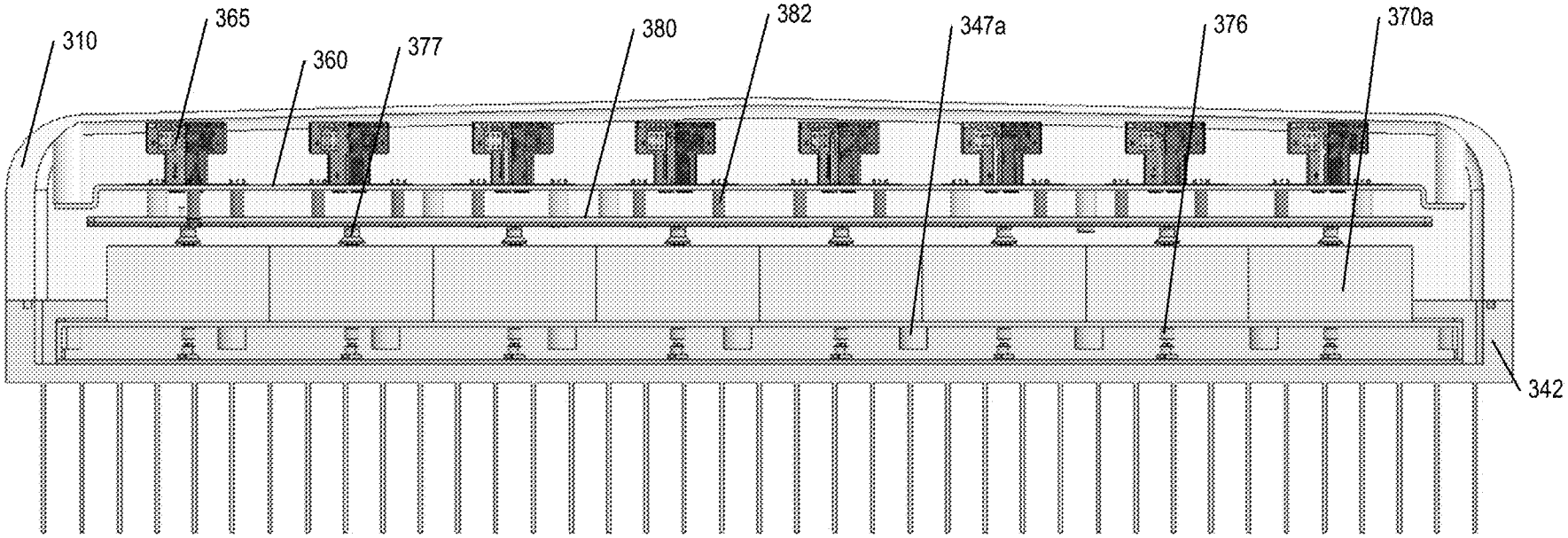
FIG. 27 is a cross-sectional view of the integrated base station antenna of FIGS. 24A, 24B, 24C, 25A, and 25B.

FIG. 27 is a cross-sectional view of the integrated base station antenna 300 of FIGS. 24A, 24B, 24C, 25A, and 25B. As shown in FIGS. 26 and 27, the duplexers 370*a* are connected to the power amplifier circuitry 347*a* through board-to-board connection points 376. The housing 342 of the radio unit module 340 may comprise a heatsink with fins extending therefrom to facilitate the dissipation of heat from the power amplifier circuitry 347*a,b* and the optical-to-electrical transceiver circuitry 345. In some embodiments, the heatsink may be configured to dissipate the heat generated by radio circuitry powered at 1300 watts that is operating at between 5%-10% efficiency. The duplexers 370*a* are coupled to a calibration board 380, which in turn is coupled to the plurality of feed boards 362 on which the columns of radiating elements 365 are mounted. The feed boards 362 are mounted on a front surface of a reflector 360, which may be a generally flat metallic surface, and may serve as a ground plane for the columns of radiating elements 365. The feed boards 362 may be coupled to the calibration board 380 via a board-to-board connection using connection points 382.

As shown in FIG. 26 and the cross-sectional view of FIG. 27, the connections between the feed boards 362 and the calibration boards 380*a,b* may be a board-to-board connections using connection points 182 on each of the calibration boards 180*a,b*, the connections between the calibration boards 380*a,b* and the duplexers 370*a,b* may each be SMP pin connections 377, and the connections between the duplexers 370*a,b* and the power amplifier circuitry modules 347*a,b* may be board-to-board connections using connection points 377. This differs from the integrated antenna base station antenna 100 in which SMP pin connections 175 are used to connect the duplexers 370*a,b* and the power amplifier circuitry modules 347*a,b*. These board-to-board connections and SMP pin connections may replace cables, which can improve electrical performance by reducing PIM and also make for a more compact assembly. Moreover, the elimination of cables at the calibration boards 380*a,b* may improve the accuracy in evaluating signal phase as cabling may introduce some phase error due to its length.

In some embodiments, phase shifters along with their associated mechanical linkages may be implemented on the feed boards 362 and hence may be mounted forwardly of the reflector 360. This may eliminate additional cables between the radiating elements 365 and separate phase shifter assemblies providing yet further improvements to PIM performance and more compactness in the overall assembly.

Figure 28A:
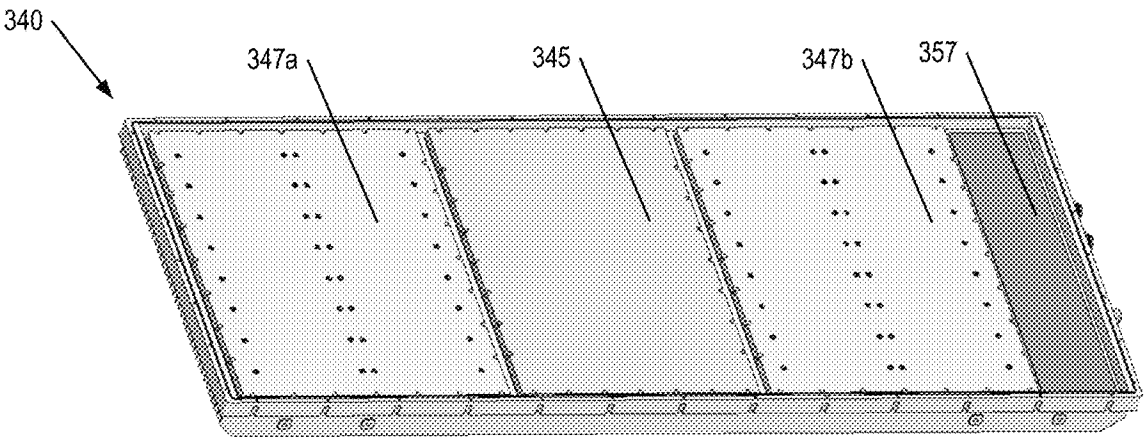
FIGS. 28A and 28B are perspective views of the radio unit module of the integrated base station antenna of FIGS. 26 and 27.
Figure 28B:
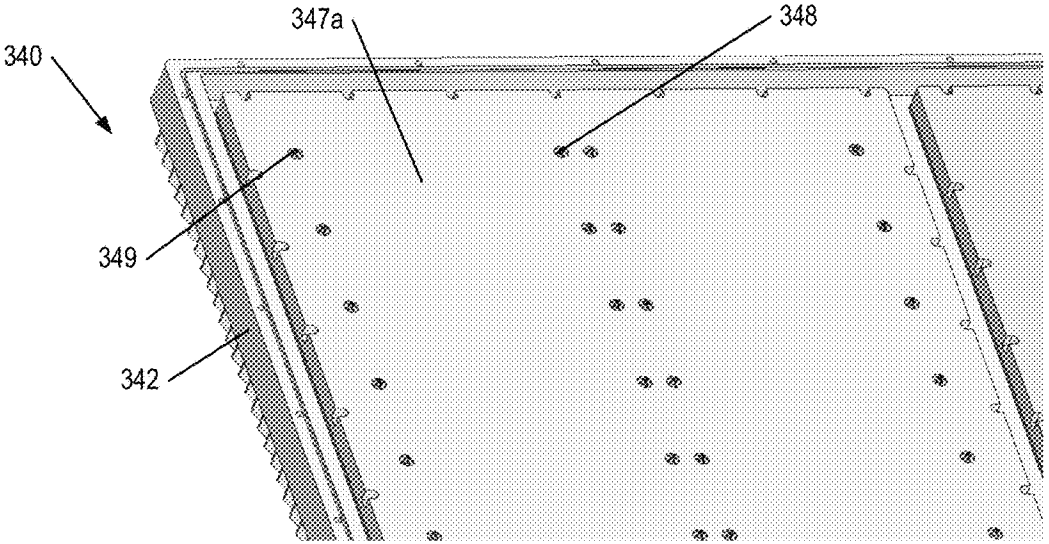

FIGS. 28A and 28B are perspective views of a radio unit module 340 according to some embodiments of the inventive concept. As shown in FIGS. 28A and 28B, the radio unit module 340 includes a housing 342, which may serve as a heatsink, and is configured to receive therein the power amplifier circuitry modules 347*a,b* with optical-to-electrical and transceiver circuitry 345, i.e., radio circuitry, mounted therebetween. Each of the power amplifier circuitry modules 347*a,b*, includes transmit ports 348 and receive ports 349. A power board 351 may provide an interface for connecting to a power supply.

Figure 29A:
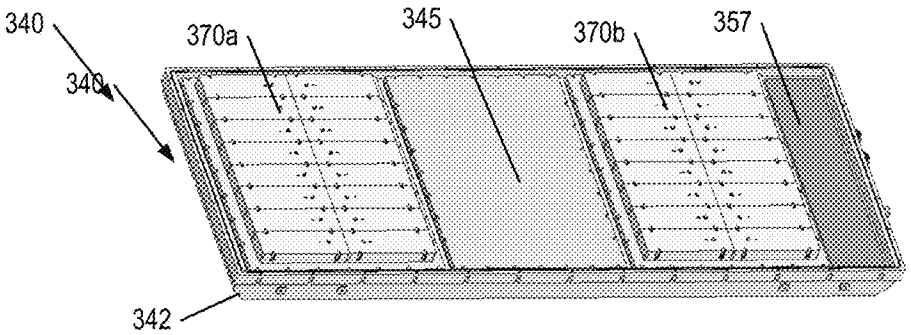
FIGS. 29A and 29B are perspective views of the duplexers mounted on the power amplifier circuitry modules of FIGS. 26 and 27.
Figure 29B:
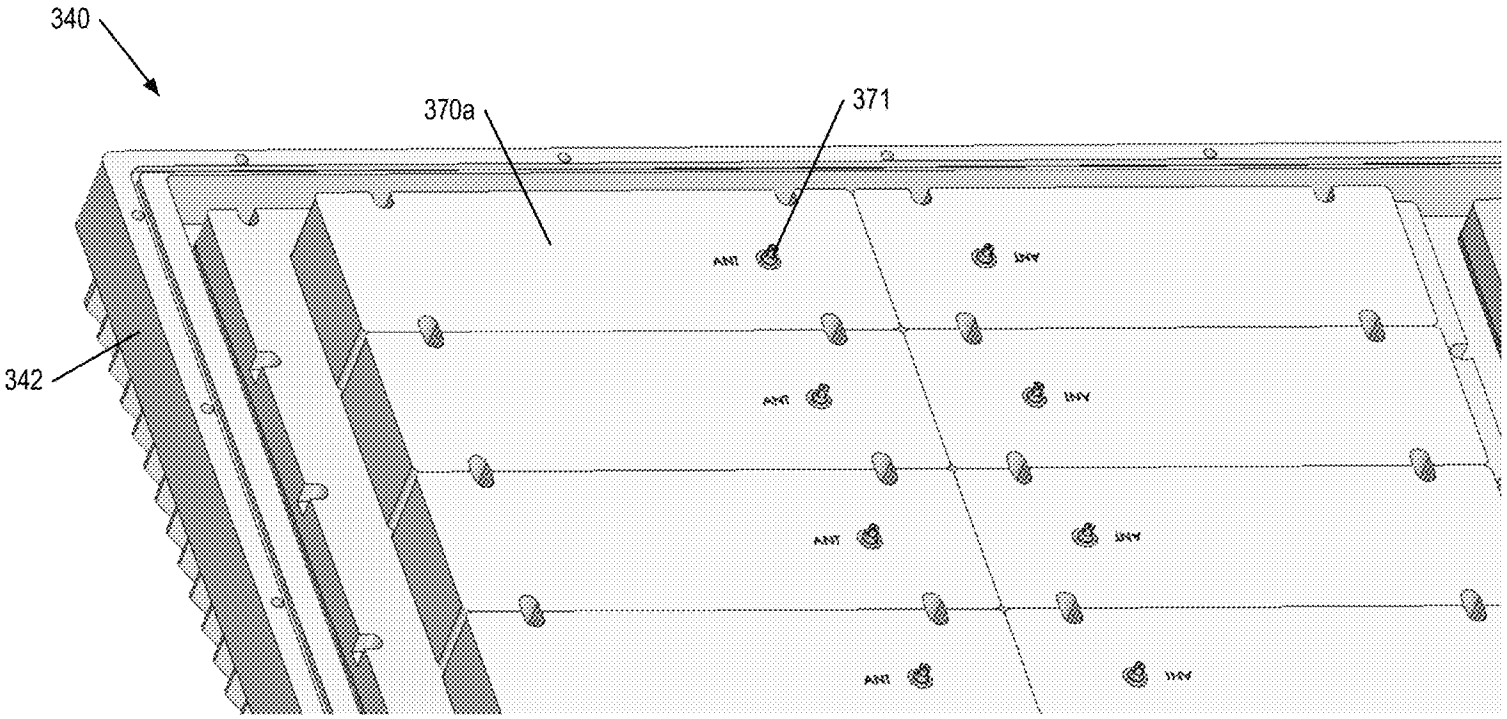

FIGS. 29A and 29B are perspective views of the duplexers 370*a,b* mounted on the power amplifier circuitry modules 347*a,b* according to some embodiments of the inventive concept. As shown in FIGS. 29A and 29B, the duplexers 370*a,b* are mounted on the power amplifier circuitry modules 347*a,b* and provide output ports 371 to the calibration boards 380*a,b*.

Figure 30A:
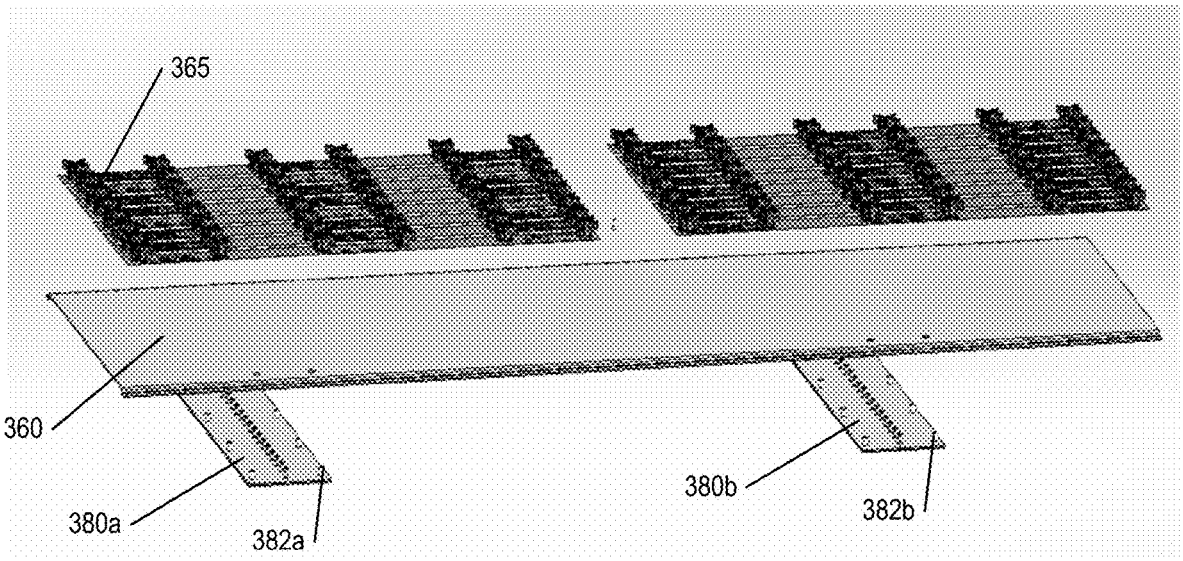
FIG. 30A is an exploded perspective view.
Figure 30B:
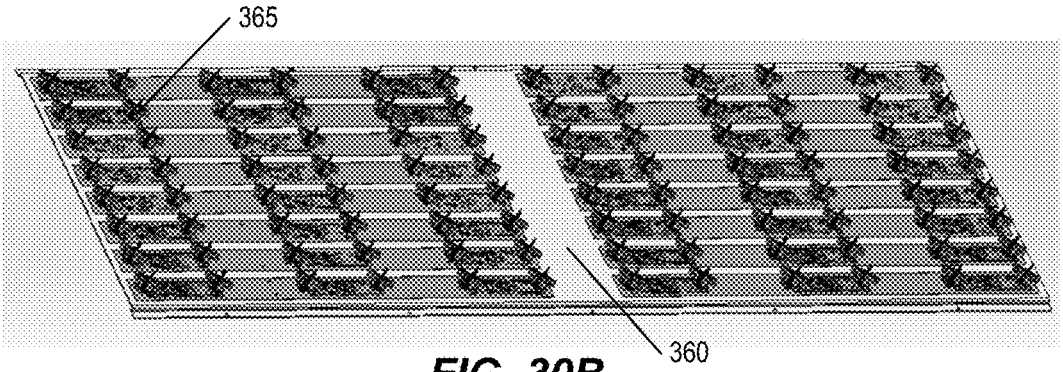
FIGS. 30B and 30C are perspective views, of the antenna and calibration board/duplexer sub-assemblies of the integrated base station antenna of FIGS. 26 and 27.
Figure 30C:
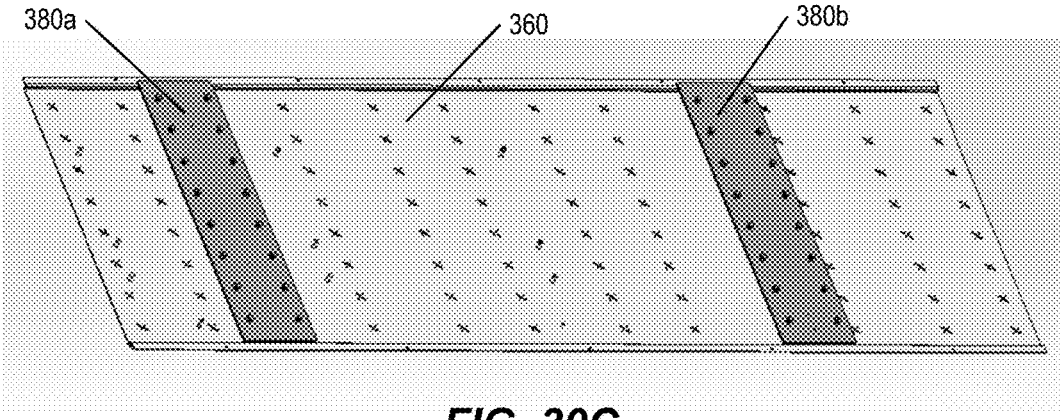

FIG. 30A is an exploded perspective view, and FIGS. 30B and 30C are perspective views, of an antenna sub-assembly of antenna 300 that includes the columns of radiating elements 365, the feed boards 362, the reflector 360, and the calibration boards 380*a,b*. As shown in FIGS. 30A-30C, the columns of radiating elements are mounted on the feed boards 362 and the calibration boards 380*a,b* may be coupled to the feed boards 362 via the board-to-board connection points 382*a,b*.

Figure 31A:
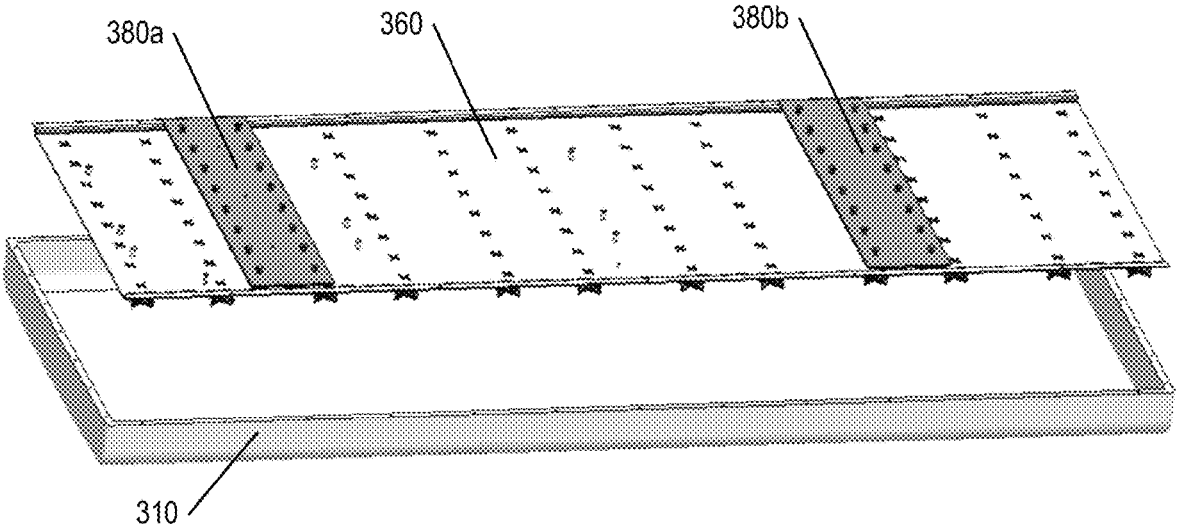
FIGS. 31A and 31B are perspective views of the sub-assemblies of FIGS. 30A-30C mounted in a radome.
Figure 31B:
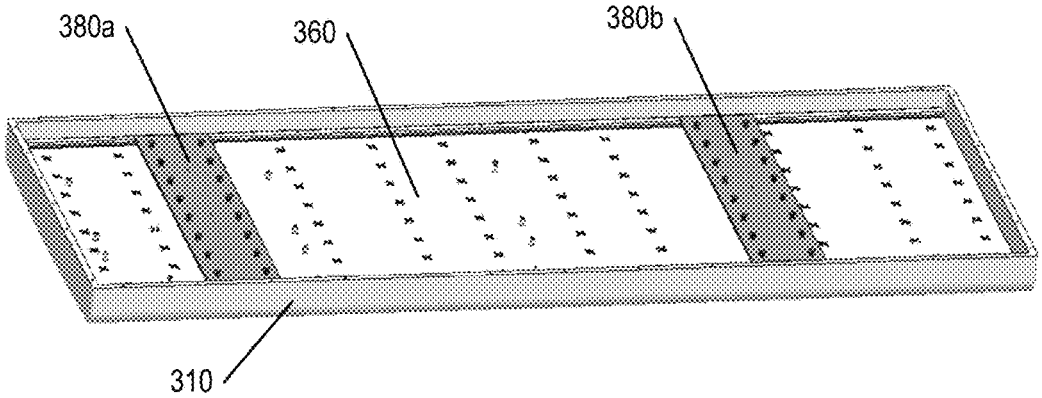

FIGS. 31A and 31B are perspective views of the sub-assemblies of FIGS. 30A-30C mounted in the radome 310. As shown in FIGS. 31A and 31B, the antenna sub-assembly including the radiating elements 365, the feed boards 362, the reflector 360, and the calibration boards 380*a,b* is mounted into the radome 310.

Figure 32A:
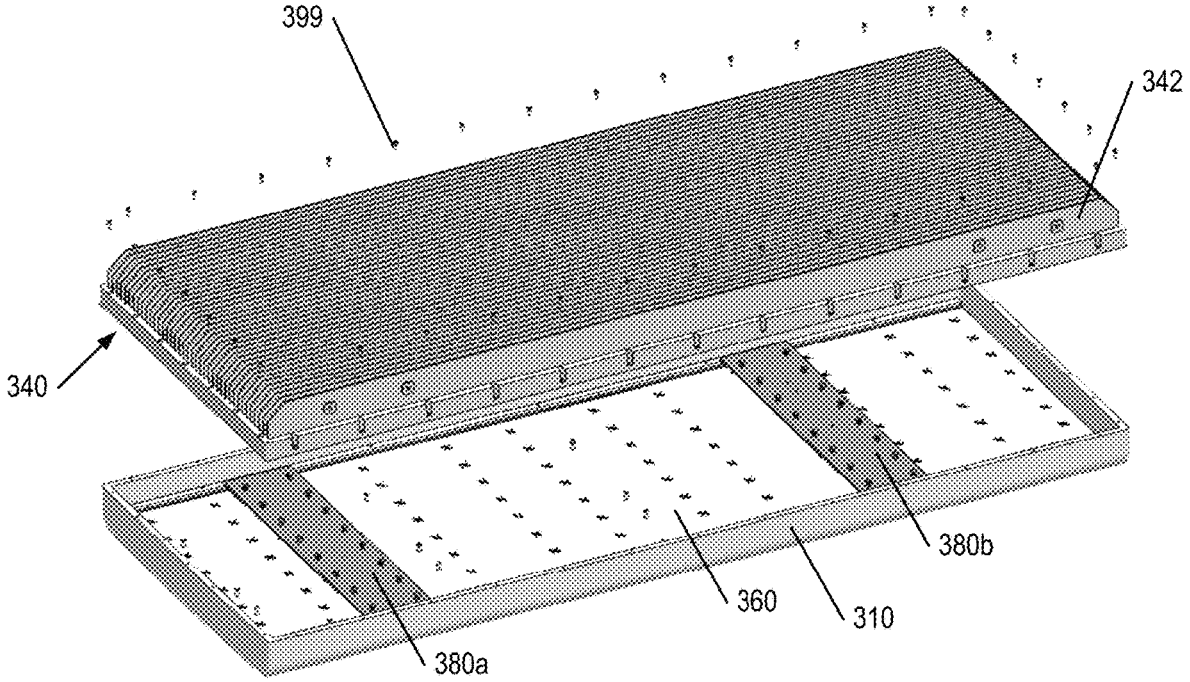
FIGS. 32A and 32B are exploded perspective views of the sub-assemblies of FIGS. 29A and 29B coupled to the sub-assemblies of FIGS. 31A and 31B.
Figure 32B:
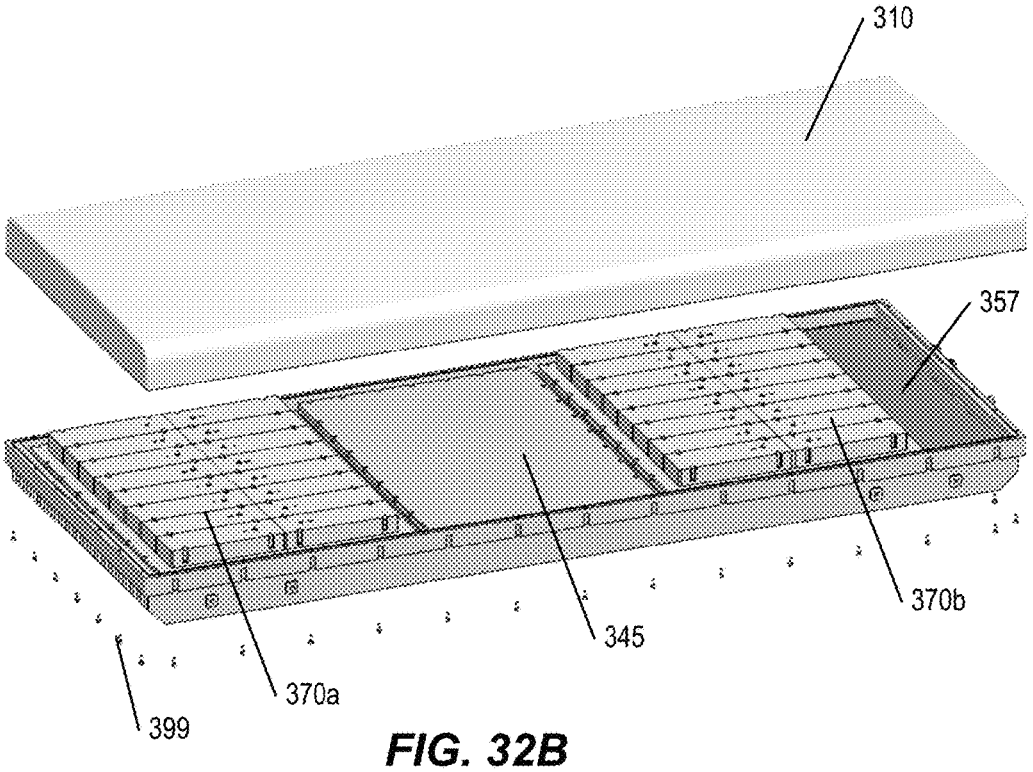
Figure 32C:
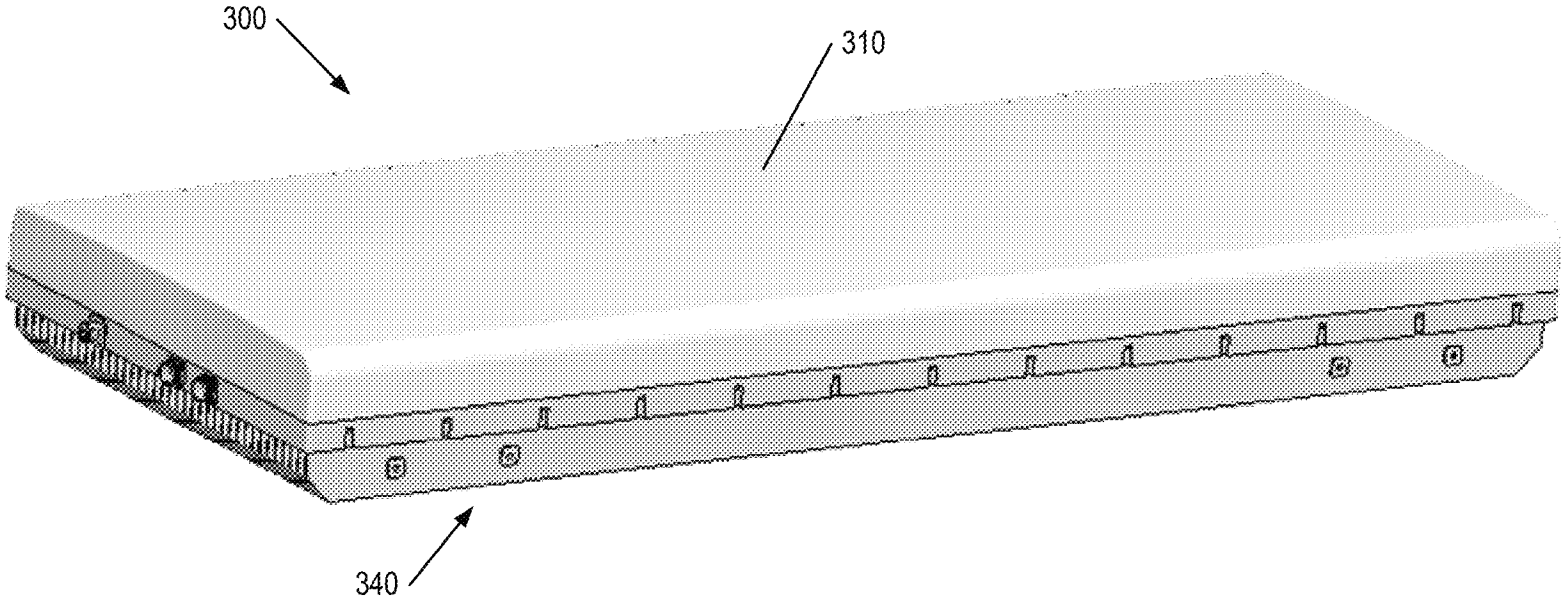
FIG. 32C is a perspective view of the sub-assemblies of FIGS. 29A and 29B coupled to the sub-assemblies of FIGS. 31A and 31B.

FIGS. 32A and 32B are exploded perspective views of the sub-assemblies of FIGS. 29A and 29B coupled to the sub-assemblies of FIGS. 31A and 31B. FIG. 32C is a perspective view of the sub-assemblies of FIGS. 29A and 29B coupled to the sub-assemblies of FIGS. 31A and 31B according to some embodiments of the inventive concept. As shown in FIGS. 32A-32C, the duplexers 370*a,b* mounted on the power amplifier circuitry modules 347*a,b* within the radio unit module 340 are coupled to the calibration boards 380*a,b* in the radome 310 with the radome 310 being coupled to the radio unit housing 342 using screws 399 or another suitable attachment mechanism.

Figure 33A:
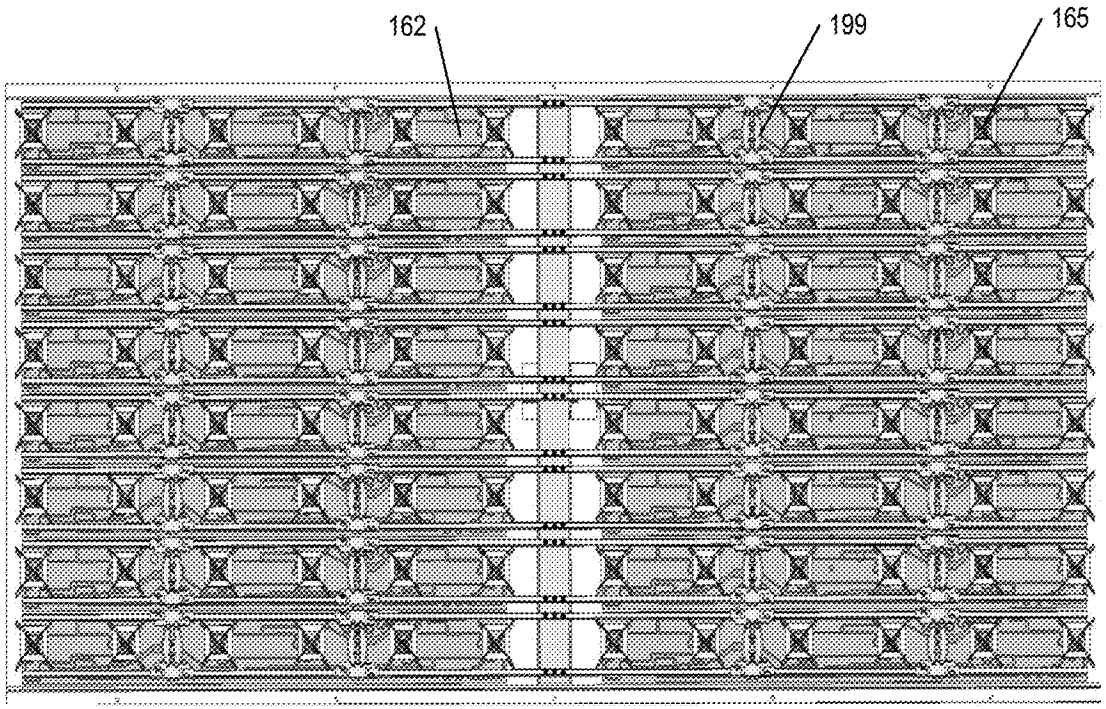
FIGS. 33A and 33B are plan views of a feed board including phase shifters mounted thereon in accordance with some embodiments of the inventive concept.
Figure 33B:
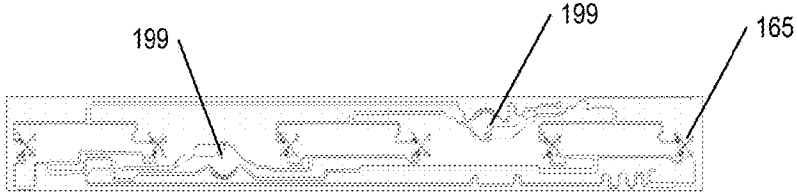

FIG. 33A is a plan view of a feed board including phase shifters thereon in accordance with some embodiments of the inventive concept. As shown in FIG. 33A, the feed board 162 includes phase shifters 199 mounted on the same side as the columns of radiating elements 165. FIG. 33B is a plan (front) view of one of the feed boards 162 before the radiating elements 165 are mounted thereon. As shown in FIG. 33B, each feed board includes two wiper arc phase shifters 199. The wiper arm of the phase shifters 199 are omitted in FIG. 33B to better show the traces on the main printed circuit board of the phase shifter (which here is feed board 162) and the input port and output ports of each phase shifter (the output ports connect to the radiating elements 165). Although the phase shifters 199 are shown in FIGS. 33A and 33B as being mounted on the front side of the feed board 162 for the integrated base station antenna 100, it will be understood that phase shifters can be mounted on the on the front side of the feed boards 262 (and reflector 260) and/or on the front side of the feed boards 362 (and reflector 360) 360 of the base station antennas 200 and/or 300 in accordance with various embodiments of the inventive concept. Thus, according to some embodiments of the inventive concept, some or all of the electromechanical phase shifters 199 may be integrated into the radiating element feed boards 162, 262, 362 instead of being separate phase shifter assemblies that are attached to the feed boards using cables. The mechanical linkages that connect the electromechanical phase shifters 199 to their associated actuators may also be at least partially implemented on the front side of the reflector, as shown in FIG. 33A. Moving the mechanical linkages in front of the reflector provides additional room behind the reflector for radio circuitry and other components.

Figure 34:
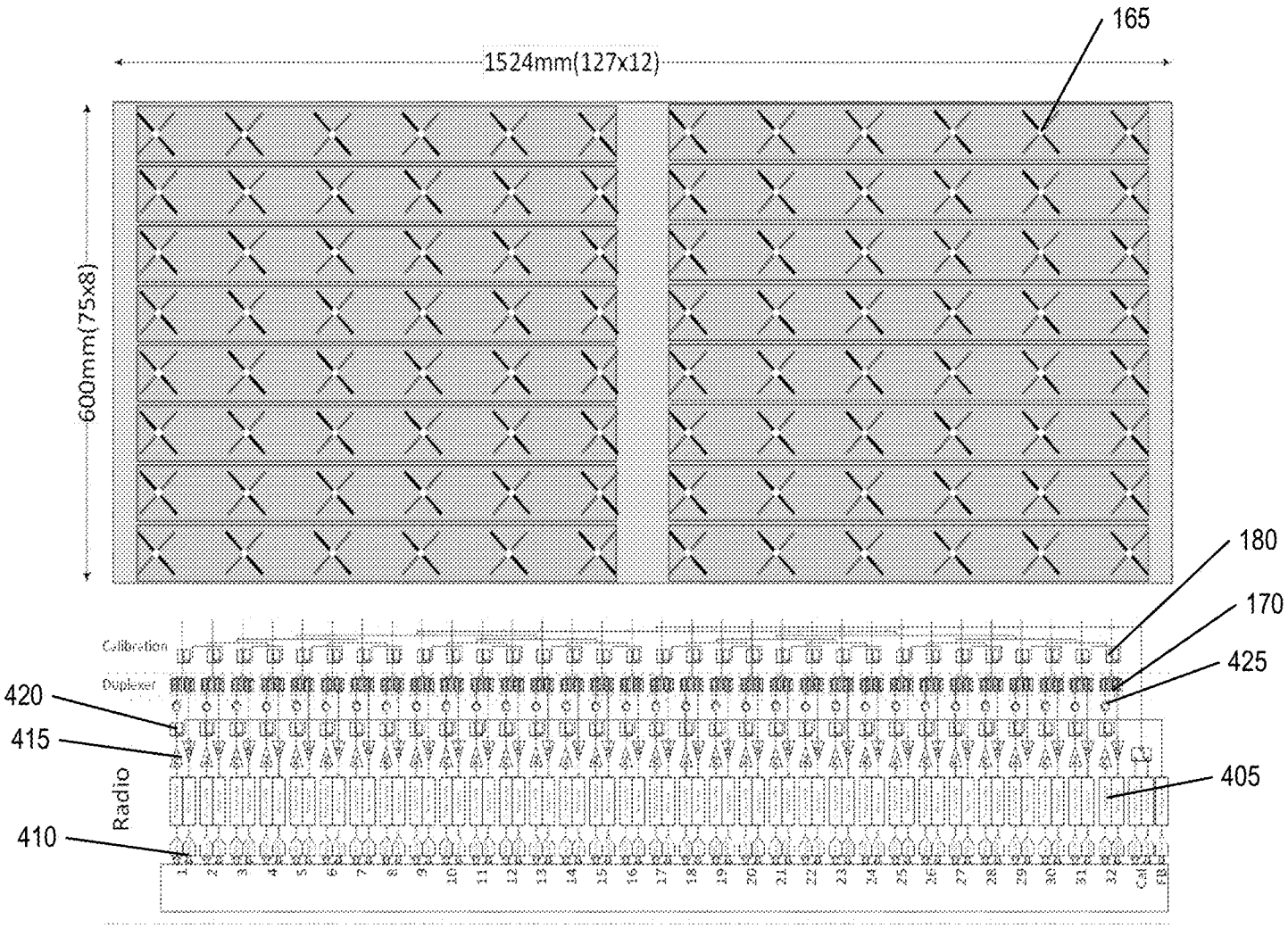
FIG. 34 is a schematic of the radio circuitry in an integrated base station antenna according to some embodiments of the inventive concept.

FIG. 34 is a schematic of the power amplifier modules in an integrated base station antenna according to some embodiments of the inventive concept. As shown in FIG. 34, the power amplifier modules comprises transmit and receive channels 405 for each of the thirty-two columns of radiators that are shown in the depicted antenna array. Two transmit/receive channels 405 are provided for each column of dual-polarized radiating elements 165 (namely one transmit/receive channel 405 for each polarization) in the antenna array, and the antenna array includes two vertically stacked sub-arrays having eight columns of dual-polarized radiating elements 165 each, thus requiring thirty-two transmit/receive channels. Each transmit/receive channel 405 is coupled between a respective analog/digital conversion circuit 410 and respective amplifier circuits 415. The amplifier circuits 415 comprise a power amplifier in the transmit path and a low noise amplifier in the receive path. The transmit path further comprises an impedance matching circuit 420 and a circulator 425 (which protects the power amplifier). The transmit and receive paths are coupled to the duplexers 170 and calibration circuits 180 as shown. The power amplifier modules of FIG. 34 may be used in any of the integrated base station antennas 100, 200, and/or 300 described herein in accordance with different embodiments of the inventive concept.

Figure 36:
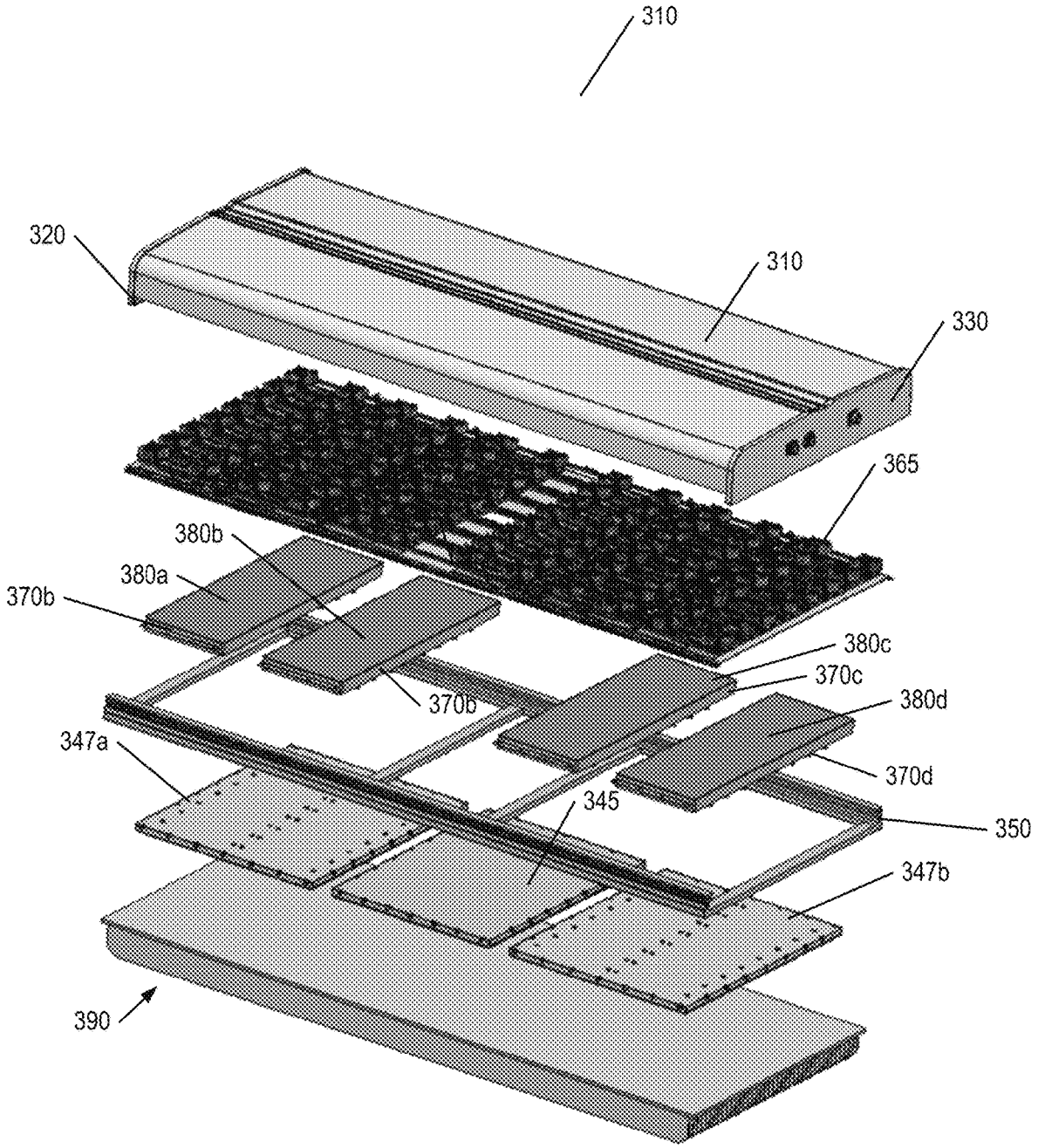
FIG. 36 is an exploded perspective view of another integrated base station antenna according to embodiments of the inventive concepts.

FIG. 36 is an exploded perspective view of an integrated base station antenna 300A that is a modified version of the integrated base station antenna 300 of FIG. 26. Referring to FIG. 36, the integrated base station antenna 300A may include the same radome 310, top end cap 320, bottom end cap 330, reflector 360, feed boards 362 and radiating elements as base station antenna 300 of FIG. 26. Base station antenna 300A includes a total of four calibration boards 380*a,b,c,d* that are connected to the antenna feed boards 362. The four calibration boards 380*a,b,c,d* are mounted on duplexers 370*a,b,c,d* respectively. Duplexers 370*a,b* are mounted on power amplifier circuitry module 347*a*, and duplexers 370*c,d* are mounted on power amplifier circuitry module 347*b*. Optical-to-electrical and transceiver circuitry 345, i.e., radio circuitry is mounted between the two power amplifier circuitry modules 347*a,b*. The power amplifier circuitry modules 347*a,b* and the optical-to-electrical and transceiver circuitry 345 are mounted on a heatsink 390. Additionally, a support framework 350 is provided that may support the duplexers 370, the calibration boards 380, the reflector 360, the feedboards 362 and/or the radiating elements 365. The design of base station antenna 300A may be particularly advantageous if different entities manufacture the antenna elements (including the calibration boards 380 and duplexers 370) versus the radio circuitry elements and heatsink.

Further Definitions and Embodiments

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Like reference numbers signify like elements throughout the description of the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive subject matter.

It will be understood that when an element is referred to as being "on", "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described to best explain the principles of the disclosure and the practical application, and to enable others of ordinary skill in the art to understand the disclosure with various modifications as are suited to the particular use contemplated.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. An integrated base station antenna, comprising:

a plurality of columns of radiating elements, each column of radiating elements mounted on a respective feed board;

a calibration circuit that includes at least one calibration board coupled to the feed boards via a plurality of cableless connections;

a plurality of duplexers coupled to the calibration circuit via sub-miniature push-on (SMP) pin connections;

a plurality of power amplifier modules, each power amplifier module including a plurality of transmit/receive circuits, each transmit/receive circuit coupled to a respective one of the duplexers via respective cableless connections; and at least one heatsink coupled to at least one of the power amplifier modules.

2. The integrated base station antenna of claim 1, wherein the feed boards are coupled to the calibration circuit via a plurality of board-to-board connections.

3. The integrated base station antenna of claim 1, further comprising a plurality of electromechanical phase shifters, wherein at least some of the phase shifters are implemented on the feed boards.

4. The integrated base station antenna of claim 3, further comprising a reflector, wherein the radiating elements extend forwardly from a front side of the reflector, and wherein at least portions of mechanical linkages that connect the respective phase shifters to actuator motors are positioned forwardly of the front side of the reflector.

5. The integrated base station antenna of claim 1, wherein the at least one heatsink comprises a plurality of heatsinks, and wherein each heatsink is connected to a respective one of the power amplifier modules, and the heatsinks are spaced apart from one another.

6. The integrated base station antenna of claim 1, wherein the duplexers are coupled to the power amplifier modules via board-to-board connections.

7. An integrated base station antenna, comprising:

a feed board having a column of radiating elements mounted thereon;

a pair of phase shifters coupled to the column of radiating elements, the phase shifters at least partly implemented on the feed board;

a calibration board that is coupled to the feed board via a board-to-board connection; and a plurality of duplexers coupled to the calibration board via sub-miniature push-on (SMP) pin connections.

8. The integrated base station antenna of claim 7, further comprising:

a reflector;

wherein the feed board, the pair of phase shifters and the column of radiating elements are all on a front side of the reflector.

9. The integrated base station antenna of claim 8, further comprising:

a mechanical linkage that is configured to adjust a setting of at least one of the pair of phase shifters, the mechanical linkage being mounted at least in part on the front side of the reflector.

10. The integrated base station antenna of claim 7, further comprising:

a plurality of power amplifiers coupled to the plurality of duplexers via SMP pin connections.

11. The integrated base station antenna of claim 10, further comprising a monolithic heatsink that is configured to receive the plurality of power amplifiers therein.

12. The integrated base station antenna of claim 10, further comprising radio circuitry mounted between a first subset of the plurality of power amplifiers and a second subset of the plurality of power amplifiers.

13. The integrated base station antenna of claim 7, further comprising:

a plurality of power amplifier modules; and a plurality of monolithic heatsinks coupled to the plurality of power amplifier modules, respectively.

14. The integrated base station antenna of claim 13, further comprising:

a calibration board coupled to the feed board via a board-to-board connection.

15. The integrated base station antenna of claim 1, further comprising a radio circuitry module having a radio circuitry module heatsink that is separate from the at least one heatsink that is coupled to at least one of the power amplifier modules.

16. The integrated base station antenna of claim 10, further comprising:

a plurality of power amplifier modules;

a radio circuitry module mounted between a first subset of the plurality of power amplifiers and a second subset of the plurality of power amplifiers; and at least one monolithic heatsink coupled to the plurality of power amplifier modules.

17. The integrated base station antenna of claim 1, wherein the calibration board includes at least one filter implemented thereon.

18. The integrated base station antenna of claim 17, wherein the filter is a low pass filter.

19. The integrated base station antenna of claim 1, wherein the calibration board includes a plurality of filters, and each filter is coupled to a respective one of the duplexers that are coupled to the calibration board.

20. The integrated base station antenna of claim 7, wherein the calibration board includes a plurality of filters.

* * * * *